US006305917B1

(12) United States Patent
Franch

(10) Patent No.: US 6,305,917 B1
(45) Date of Patent: Oct. 23, 2001

(54) PUMP CONSISTING OF A MECHANISM TRANSMITTING TO A TUBULAR CIRCUIT SYSTEM PERIODIC ROTATIONAL INERTIAL FORCES DEVELOPING IN THE LIQUID CONTAINED THEREIN CONTINUOUS PRESSURE AND FLOW

(76) Inventor: Gino Franch, Via Col di Lana 5, 1-39100, Bolzano (BZ) (IT)

( * ) Notice: Subject to any disclaimer, the term of this patent is extended or adjusted under 35 U.S.C. 154(b) by 0 days.

(21) Appl. No.: 09/312,875

(22) Filed: May 17, 1999

(30) Foreign Application Priority Data

Jun. 9, 1998 (IT) ..... BZ98A0035

(51) Int. Cl.[7] ..... F04F 7/00; F04B 19/02
(52) U.S. Cl. ..... 417/461; 417/104; 417/240
(58) Field of Search ..... 417/240, 241, 417/104

(56) References Cited

U.S. PATENT DOCUMENTS

| | | | | |
|---|---|---|---|---|
| 391,189 | * | 10/1888 | Pontallie | 417/104 |
| 3,077,162 | * | 2/1963 | Banerian | 417/241 |
| 3,617,152 | * | 11/1971 | Mowry | 417/241 |
| 3,737,253 | * | 6/1973 | Foote | 417/241 |
| 4,370,101 | * | 1/1983 | Vander Horst | 417/241 |

* cited by examiner

*Primary Examiner*—Teresa Walberg
*Assistant Examiner*—Thor Campbell
(74) *Attorney, Agent, or Firm*—Shlesinger, Fitzsimmons & Shlesinger

(57) ABSTRACT

The details necessary for embodying the present invention are: a supporting frame; two rotors; a system for the periodic alternating motion thereof with phases of 0° and 90°; two tubular 2-phase circuits (CB) consisting of two parallel identical tubes termed "active circuits" with an inlet and outlet tube at the connection points; starting from the inlet, where to each circuit is applied a one-way valve with the task of allowing only inlet of the liquid, the two circuits constituting the CB are wound one with right-hand direction and the other with left-hand direction; on each rotor an identical CB is fastened. The inlet of the first CB is connected with the feed source and the outlet with the inlet of the other CB, whose outlet is connected with the user. The connections of the 2-phase circuits are made with flexible tubes. With crankshaft rotation the two CBs develop a pressure differential and a continuous flow with valves constantly open. The operating principle is extended to various types of CB by use of two rotors out of phase by 90° or of four rotors out of phase by 0°, 90°, 180° and 270° in order to obtain 2-phase, 4-phase or multifunction pumps.

17 Claims, 13 Drawing Sheets

$f_{1'}$
$f_1$
$f_{1'}$
$f_{2'}$
$f_2$
$f_{2'}$
0°
90°
180°
270°
360°

PUMP CONSISTING OF A MECHANISM TRANSMITTING TO A TUBULAR CIRCUIT SYSTEM PERIODIC ROTATIONAL INERTIAL FORCES DEVELOPING IN THE LIQUID CONTAINED THEREIN CONTINUOUS PRESSURE AND FLOW

DESCRIPTION

The present invention relates to a pump consisting of a mechanism transmitting to a tubular circuit system periodic rotational inertial forces developing in the liquid contained therein continuous pressure and flow.

One of the purposes of the present invention is to make available a pump having simple design, versatile employment and economical manufacture. Another purpose is to make available a pump requiring few members subject to wear, of small size, and designed for amplification to greater flows and pressures.

This and other purposes discussed in the description are achieved in a pump having the characterizing characteristics disclosed hereinafter.

The pump proposed has the advantage of developing pressure in tubular circuits along the axis of which rotational inertial forces cause an elementary pressure differential at all points of the liquid contained and whose integral originates at a pressure increasing from the inlet to the outlet of the circuit. In this manner the liquid is not subject to any mechanical operation and therefore displays exceptionally small hydraulic losses.

The pump proposed has the advantage of not having any predetermined rotation speed such as for example in piston pumps nor any particular rotation speed as in centrifugal pumps while the only speed limit of the pump proposed is that determined by the strength of the materials employed in its construction.

The pump proposed has the advantage of not having mechanical members like pistons, diaphragms for protection thereof, number of impellers in relation to pressure developed, nor hydraulic devices designed to convert kinetic energy into pressure energy. These members reduce efficiency and increase construction and maintenance costs. The only additional members of the proposed pump are the one-way valves which however are always open with the one exception of the transitory starting phase.

In the proposed pump the pressure developed is proportionate to the product $\rho n_s \phi_o r_o^2 n^2$ in which the variables $n_s$ and $\phi_o$ have the character of absolute novelty.

Concerning the variable n=number of revolutions per second it is noted in particular that in the case of the pump proposed it can increase continuously until it reaches a value limited only by the mechanical characteristics set for the machine and accordingly the small upper limit of n as in piston pumps or a particular value of n necessary for its operation as in centrifugal pumps is to be excluded.

Concerning the variable $\phi_o°$ it is noted that it can easily be set in the range $\phi$ (1°; 10°) and that accordingly its value can be selected to obtain the desired values for the other variables in play.

Concerning the variable $n_s$=number of turns of the active circuit it is noted that it replaces the function of the plurality of the impellers and associated diffusers adopted in centrifugal pumps to increase developed pressure. Replacement with the number of turns has the advantage of a radical design simplification and reduction of manufacturing and maintenance costs. In addition the number $n_s$ can be readily corrected with small changes in $\phi_o$, $r_o$ and n.

The kinetic energy of the proposed pump is constant because it consists of one or two pairs of identical oscillating rotors with equal frequency and with phase difference of 90°. This makes flywheel counterweights unnecessary.

The peak centrifugal force of the oscillating counterweights 'm' expressed by $f_c = m r_o \dot{\theta}^2 \phi_o^2$ is relatively small because the coefficient $\phi_o^2 < 0{,}03$ reduces the value of the above mentioned product to less than 3%. This simplifies rotor balancing.

The proposed pump has the advantage of not having members like stuffing boxes, diaphragms and pistons for the above reasons and also because these are the most likely cause of possible losses of dangerous liquids.

The proposed pump has the advantage of being able to perform pumping even of slushy water because it is made up of smooth tubes having slight hydraulic resistance at every point of which an additional pressure increase is generated.

The proposed pump together with the advantage of exceptionally high efficiency, relatively negligible construction and maintenance costs and great versatility of use displays the exclusive advantage of being convertible at negligible additional cost into a multifunction pump to meet many pumping requirements simultaneously.

Further characteristics, details and advantages appear in the following description of various embodiments of the present invention as set forth in the following paragraph headings A. B. and C., and associated numbered paragraphs with reference to the figures of the accompanying drawings.

A) 1) Mechanical details,

2) Key for symbols used,

3) Description of FIGS,

B) 1) Single active circuits, 2) 2-phase circuits,

3) Embodiment of 2-phase circuits in accordance with diagram a), b), c), d), e), C) 1) 2-phase pump, 2) 4-phase pump, 3) Multifunction pump, 4) 2-phase circuit connections, 5) oscillating rotor motion generated by a guided bearing.

A.1) Mechanical Details no. 1—Support frame no. 2—Rotor $R_1$ oscillating around the shaft 15 and coupled with a connecting rod and crank applied to the shaft 4 with phase angle $\theta$=0°, no. 3—Rotor $R_2$ oscillating around the shaft 16 or if absent around the shaft 15 and coupled with connecting rod and crank applied to the shaft 4 with phase angle $\theta$=90°, no. 4—Crankshaft for the oscillating motion of the rotors oscillating on the bearings 11 fastened to the frame 1 to which the motor is applied, no. 5—Crank applied to the shaft 4 for the oscillating motion of $R_1$ with angular position on the shaft 4 $\theta$=0° (see FIG. 1), no. 6—Crank for the oscillating motion of $R_2$ with angular position on the shaft 4 $\theta$=90° (see FIG. 1), no. 7—Pin of the crank coupled to the big end of connecting rod 9, no. 8—Rotors $R_{11}$ and $R_{22}$ coupled with the connecting rods and cranks arranged on the shaft 4 with phase angles $\theta$=180°, 270° respectively, no. 9—Connecting rod for the motion of $R_1$, no. 10—Connecting rod for the motion of $R_2$, no. 11—Bearing of the shaft of the cranks 4, no. 12—Pin of the crank coupled to the big end of the connecting rod 10, no. 13—Gudgeon pin 13 coupled to the small end of the connecting rod 9 fastened to the rotor no. 14—Gudgeon pin of the connecting rod 10 fastened to the rotor $R_2$, no. 15—Shaft fastened to the support frame 1 around which turn the pertinent rotors, no. 16—Shaft fastened to the support frame 1 around which turn the pertinent rotors, no. 17—Rotation bearing of $R_1$ and $R_{11}$, no. 18—Rotation bearing of $R_2$ and $R_{22}$, no. 19—Single left-hand active circuit $C_1$ no. 20—Single right-hand active circuit $C_{1'}$ no. 21—Single left-hand active circuit $C_{11}$ no. 22—Single right-hand active circuit $C_{11'}$ no. 23—Single left-hand active circuit $C_2$ no. 24—Single right-hand active circuit $C_{2'}$ no. 25—Single left-hand active circuit $C_{22}$ no. 26—Single right-hand active circuit $C_{22'}$ no. 27—One-way valve $V_1$ located at the inlet of the circuit 19, no. 28—One-way valve $V_{1'}$ located at the inlet of the circuit 20, no. 29—One-way valve $V_2$ located at the inlet of the circuit 23, no. 30—One-way valve $V_{2'}$ located at the inlet of the circuit 24, no. 31—One-way valve $V_{11}$ located at the inlet of the circuit 21, no. 32—One-way valve $V_{11'}$ located at the inlet of the circuit 22, no. 33—One-way valve $V_{22}$ located at the inlet of the circuit 25, no. 34—One-way valve $V_{22'}$ located at the inlet of the circuit 26, no. 35—2-phase circuit $CB_1$ consisting of $C_1$ and $C_{1'}$ with the valves $V_1$ and $V_{1'}$ fastened on $R_1$, no. 36—2-phase circuit $CB_{11}$ consisting of $C_{11}$ and $C_{11'}$ with the valves $V_{11}$ and $V_{11'}$ fastened on $R_{11}$ or if absent on $R_1$, no. 37—2-phase circuit $CB_2$ consisting of $C_2$ and $C_{2'}$ with the valves $V_2$ and $V_{2'}$ fastened on $R_2$, no. 38—2-phase circuit $CB_{22}$ consisting of $C_{22}$ and $C_{22'}$ with the valves $V_{22}$ and $V_{22'}$ fastened on $R_{22}$ or if absent on $R_2$, no. 39—Flexible tube joining a fastened point with a moving point, no. 40—, no. 41—Straight connector fastened to frame 1, no. 42—U connector with or without outlet fastened to frame 1, no. 43—T connector with rod equipped with L connector for connecting 2-phase circuit to flexible tube, no. 44—Connector shown in FIG. 17, no. 45—Guide for external ring of a bearing, A.2) Key to Symbols Used $\bar{a},\bar{b},\bar{c}$ versors of the reference axes x, y, z, $CB_i$ 2-phase circuit i where i=1,11,2,22, $C_i$ Active circuit wound starting from inlet with left-hand direction with respect to the versor $\bar{c}$ of the axis z. where i=1,11,2,22, $C_{i'}$ Active circuit wound starting from the inlet with right-hand direction with respect to the versor $\bar{c}$ of the axis z. where i'=1',11',2',22', $d_c$, $d_e$ Inside and outside diameters of the tube from which the active circuit is made and, $f_i$,$f_{i'}$ Instantaneous value of the inertial forces stressing the liquid in the outlet sections $C_1$ and $C_{1'}$, $F_o$ Highest value of $f_i$ where i=1,1', 2, 2',11,11',22,22', n revolutions per second of the crankshaft, $n_s$ Number of turns of the circuit $C_i$ (where i=1,1',2,2',11, 11',22,22'), $n_T$ Number of sections making up the circuits $C_1$ and $C_{1'}$, $p_s$ Useful counterpressure applied to the pump outlet section, $p_{cs}$ Mean pressure loss for liquid motion of the active circuits $C_1$ and $C_2$, $p_e$ Mean pressure loss for motion of the liquid in the external circuits, $p_H=p_s+p_{cs}+p_e$=total counterpressure, $p_{GO}$ Mean pressure generated by the pump, $r_O$ Distance from the axis z of the active circuit axis points, $S_O$ Surface area of the projection of the active circuit on the plane (O,x,y), $E'_i$, $U'_i$ Inlet and outlet cross sections of the circuits $C_i$ where i=(1,1',11,11',2,2',22,22'), $E_i$, $U_i$ Movable inlet and outlet sections of the 2-phase circuit $CB_i$ where i=1,11,2,22, $E_o$, $U_o$ Inlet and outlet section of the pump, fastened with respect to the frame 1, $S_c$ Cross section of the active circuit, $R_1$ Rotor with relative phase θ=0° on which is fastened $CB_1$ and also $CB_{11}$ in the absence of $R_{11}$, $R_2$ Rotor with relative phase θ=90° on which is fastened $CB_2$ and also $CB_{22}$ in the absence of $R_{22}$, $R_{11}$Rotor with relative phase θ=180° on which is fastened $CB_{11}$, $R_{22}$ rotor with relative phase θ=270° on which is fastened $CB_{22}$, θ rotation angle of the crankshaft=angle theta, θ (a,b) range of the angle θ with ends a and b, $$\dot{\theta} = \frac{d\theta}{dt}$$

=angular velocity of the crankshaft=primary derivative of the angle θ with respect to time, $$\ddot{\theta} = \frac{d^2\theta}{dt^2}$$

=angular acceleration of crankshaft assumed null,

ρ liquid mass volume contained in active circuits=rho

ϕ rotation angle of rotor=angle phi, $\phi_0$ peak periodic rotation of rotor=angle phi with zero, $$\dot{\varphi} = \frac{d\varphi}{dt}$$

angular velocity of rotor=primary derivative of phi with respect to time, $$\ddot{\varphi} = \frac{d^2\varphi}{dt^2}$$

angular acceleration of rotor=secondary derivative of phi with respect to time,

A.3) DESCRIPTION OF FIGURES

FIG. 1 describes an example of the methods to be observed in developing a rotational inertial force field in a 2-phase circuit. The FIG defines, a) the shape of the rotor $R_1$, b) the positions of point O denoting the axis of the crankshaft 4, point $O_1$ denoting the axis of shaft 15 denoting rotor $R_1$, point $B_1$ of the axis of the pin 7 of crank 5 coupled to the big end of connecting rod 9 and point $B_2$ denoting the axis of the gudgeon pin 13 fastened to the rotor $R_1$ and coupled to the small end of the connecting rod 9 with it being assumed that the four axes are parallel and the points O, $0_1$, $B_1$, $B_2$ coplanar, and c) the position of the inlet $E_1$ and the outlet $U_1$ of the 2-phase circuit.

a) The rotor $R_1$ comprises of two sheet metal plates of adequate thickness and circular shape in the center of each of which is made a hole for application of the bearings 17 of the rotor rotation shaft 15 and the gudgeon pin 13 in the position indicated in this FIG. The two plates are connected coaxially by a cylindrical lamination which is shown in cross section FIG. 1 and which allows crossing of the connecting tubes and connecting rod;

b) $\theta=0°$ is established as the rotation angle of the crank 5 opposite which angular velocity of the rotor $R_1$ is greatest. After O and $O_1$ are established and the straight line for O perpendicular to $OB_1$ is traced for $\theta=0°$ the intersection from its point $O_M$ with the perpendicular is determined for $O_1$. The two points $O_2$ and $O_3$ on the straight line $OO_M$ are established so that $O_2O_M=O_M0_3=OB_1$. The lengths $OB_1$ and $O_1O_M$ are established so that the angle at the vertex $O_1$ of the triangle $=O_1O_3O_2$ has a value of $2\phi_0$ where $\phi_0$ is the predetermined peak angular amplitude with clockwise and counterclockwise direction of the rotor R1. The exactness of the calculation of $\phi_0$ above increases with increase at $OO_M$ and decrease at $\phi_0$. The circuits $C_1$ and $C_{1'}$ are fastened by brackets to $R_1$ as illustrated in the figure.

c) The position of the inlet $E_1$ and outlet $U_1$ of the 2-phase circuit is set near the ends of the rotor diameter parallel to the straight line $OO_M$ to prevent interference with other components and make the connection with the other circuits as straight as possible. The position of the inlet $E_1$, but always accompanied by the one-way valve pair, can always be exchanged with the position of the outlet $U_1$. One proceeds in the same manner for the other rotors paired to the same shaft 4 by means of cranks with phase angle with respect to the crank of $R_1$ specified in the description.

FIG. 2 shows the four 2-phase circuits $CB_1$, $CB_{11}$, $CB_2$, $CB_{22}$ consisting in an orderly manner of the four pairs of active circuits ($C_1$, $C_{1'}$), ($C_{11}$, $C_{11'}$), ($C_2$, $C_{2'}$), ($C_{22}$, $C_{22'}$). These are made from a tube bent along a circumference from which in diametrically opposite positions are branched the inlet $E_i$ and the outlet $U_i$ where i=1,11,2,22. Each 2-phase circuit of which for the sake of simplicity only the barycentric axis is shown has opposite the external inlet $E_i$ an internal cross section $E'_i$—of which one diameter is part of the longitudinal axis of $E_i$—constituting the common inlet of $C_i$ e $C_{i'}$. Opposite this are inserted the two directional valves $V_i$ and $V_{i'}$ having opposite permitted direction which starting from their inlet is left-hand for the circuit $C_i$ and right-hand for the circuit $C_{i'}$. Both circuits end opposite the section $U'_i$ of which one diameter is common to the longitudinal axis of the external outlet $U_i$ of the 2-phase circuit.

FIG. 3 shows a 2-phase circuit $CB_i$ where i=1,11,2,22 consisting of a tube bent along a circumference from which the inlet $E_i$ and outlet $U_i$ of the 2-phase circuit are branched in diametrically opposite positions.

FIG. 3 shows the section $E'_i$ common to the two circuits $C_i$ and $C_{i'}$, the 1-way valves $V_i$, $V_{i'}$ and the common inlet $E'_i$ and outlet $U'_i$ sections of the two circuits $C_i$ and $C_{i'}$.

FIG. 4 shows a 2-phase circuit made from a cylindrical spiral consisting of an odd number of turns. At the halfway point of the winding to which correspond the number of turns of each active circuit expressed by $n_s$=K+0,5 where K is a whole number there is branched the inlet $E_i$ having the section $E'_i$ internal and common to the two circuits $C_i$ and $C_{i'}$ where i=1,11,2,22 and which after a path of $n_s$ turns with opposite rotation direction have the internal outlet sections $U'_i$ and $U'_{i'}$ from whose joint is branched the outlet $U_i$. This way the origins of the inlet and outlet axes of the 2-phase circuit belong to two distinct halves of a plane divided by the longitudinal axis of the cylindrical spiral. This axis coincides with the rotation axis of the rotor to which is fastened the 2-phase circuit. Opposite $E'_i$ are applied the valves $V_i$ e $V_{i'}$ each with conduction direction towards the corresponding outlet. With the broken lines the spiral projection appears on the parallel and opposite plane. In the FIG for greater clarity the spirals are mutually spaced whereas in reality they are side-by-side.

FIG. 5 shows the axes of the two circuits $C_i$ and $C_{i'}$ where i=1,11,2,22 bent back from the inlet to the outlet respectively in left-hand and a right-hand directions in two Archimedean spiral sections and connected to form a 2-phase circuit $CB_i$. The two circuits are identical because they can be superimposed after overturning by 180° of the supporting plane of one of them. They have a number of turns $n_s$=k+0,5 where k is a whole number so that the inlet $E_i$ and outlet $U_i$ correspond to two opposing radii of the spiral.

The two circuits connected by a broken line to aid understanding are to be superimposed on two parallel planes so that the points of the pairs ($E'_i$;$E'_{i'}$), ($U'_i$, $U_{i'}$) to be joined with a connector of the type shown in FIG. 17 will be contiguous and from which the inlet Ei can be branched from $E'_i$ and the outlet $U_i$ can be branched from $U'_i$ of the 2-phase circuit. In this manner $E_i$ and $U_i$ take a position analogous to that described for FIG. 4. The 1-way valves $V_i$ and $V_{i'}$ are inserted opposite $E'_i$ and $E'_{i'}$.

FIG. 6 shows the axes of the two circuits $C_i$ (left-hand) and $C_{i'}$ (right-hand) of a 2-phase circuit $CB_i$ both made up of the same odd number of identical Archimedean spiral sections. Each section has a number of turns $n_s$=k+0,5 where k is a whole number; this entails a position on opposite radii of the inlet and outlet of each section. Furthermore two successive sections have inlets and outlets alternately internal and external. The above characteristics make possible orderly superimposition on the section [1] of all the other sections [2], [3], [4], [5], [6] shown in the FIGS making it possible to connect the inlets E and outlets U which are contiguous after the superimposition and also to branch the inlet $E_i$ and the outlet $U_i$ of the 2-phase circuit from the connection of $E'_i$ with $E'_{i'}$ and $U'_i$ with $U'_{i'}$. $E_i$ and $U_i$ take a position analogous to that described for FIG. 4. The 1-way valves $V_i$ and $V_{i'}$ are inserted at $E'_i$ and $E'_{i'}$.

FIG. 7 shows the assembly diagram of a 2-phase pump with the use of a series of two 2-phase circuits $CB_1$ e $CB_2$. In it the liquid follows the path indicated in the FIG i.e. connector no. 41 fastened to the frame no. 1, inlet of pump $E_{01}$, flexible tube no. 39, movable inlet $E_1$, path to outlet $U_1$ described in FIGS. 2) and 3), flexible tube no. 39, fastened outlet $U_{O1}$ of $CB_1$, connector no. 41, inlet $E_{02}$ of $CB_2$, flexible tube no. 39, movable inlet $E_2$, path to $U_2$ described in FIGS. 2 and 3, flexible tube no. 39, outlet of pump $U_{02}$, connector no. 41.

FIG. 8 shows the assembly diagram of a 4-phase pump consisting of two 2-phase pumps in parallel. Each of these consists of a series of two identical 2-phase circuits but arranged in such a manner that the inlet of the 4-phase pump consists of the parallel of the four circuits $C_1$, $C_{1'}$, $C_{22}$, $C_{22'}$ with relative phase at θ=0°, 180°, 90°, 270°. This entails practically complete equalization of the flow at the inlet E0 and outlet $U_0$. The liquid path between the inlets and outlets ($E_{01}$, $U_{02}$) and ($E_{022}$, $U_{011}$) is fully analogous to that described for FIG. 7.

Figures 9, 10, 11:
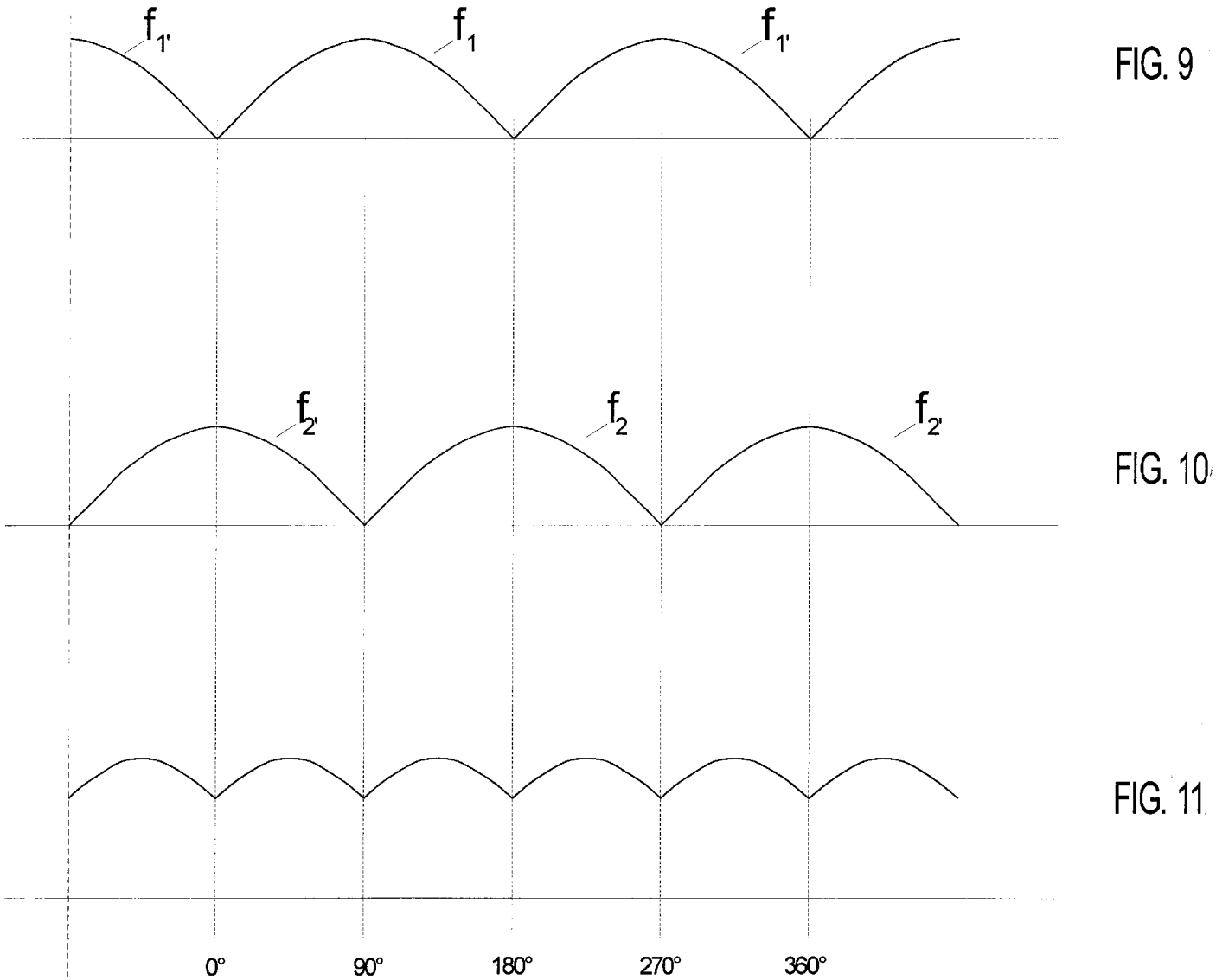
FIG. 9 shows the sinusoidal behavior of the positive components of the inertial forces $f_1$ and $f_{1'}$ applied to the liquid at the outlet of the respective circuits $C_1$ and $C_{1'}$ in the range θ (0°; 360°). Both the forces are developed in the 2-phase circuit $CB_1$ of a 2-phase pump.
FIG. 10 shows the sinusoidal behavior of the positive components of the inertial forces $f_2$ e $f_{2'}$ applied to the liquid at the outlet of the respective circuits $C_2$ e $C_{2'}$ in the range θ (0°; 360°). Both the forces are developed in the 2-phase circuit $CB_2$ of a 2-phase pump.

FIG. 11 shows the behavior of the resultant of the positive components of the inertial forces shown in FIGS. 9 e 10. Behavior on the assumption that the 2-phase circuits of FIGS. 9 e 10 are identical is identical to that developed by a 2-phase pump between the ends $E_{01}$ and $U_{02}$ in the range (0°; 360°). The inertial force developed has a minimum value equal to the peak value shown in FIGS. 9 and 10 and a peak value √2 times greater.

Figure 12:
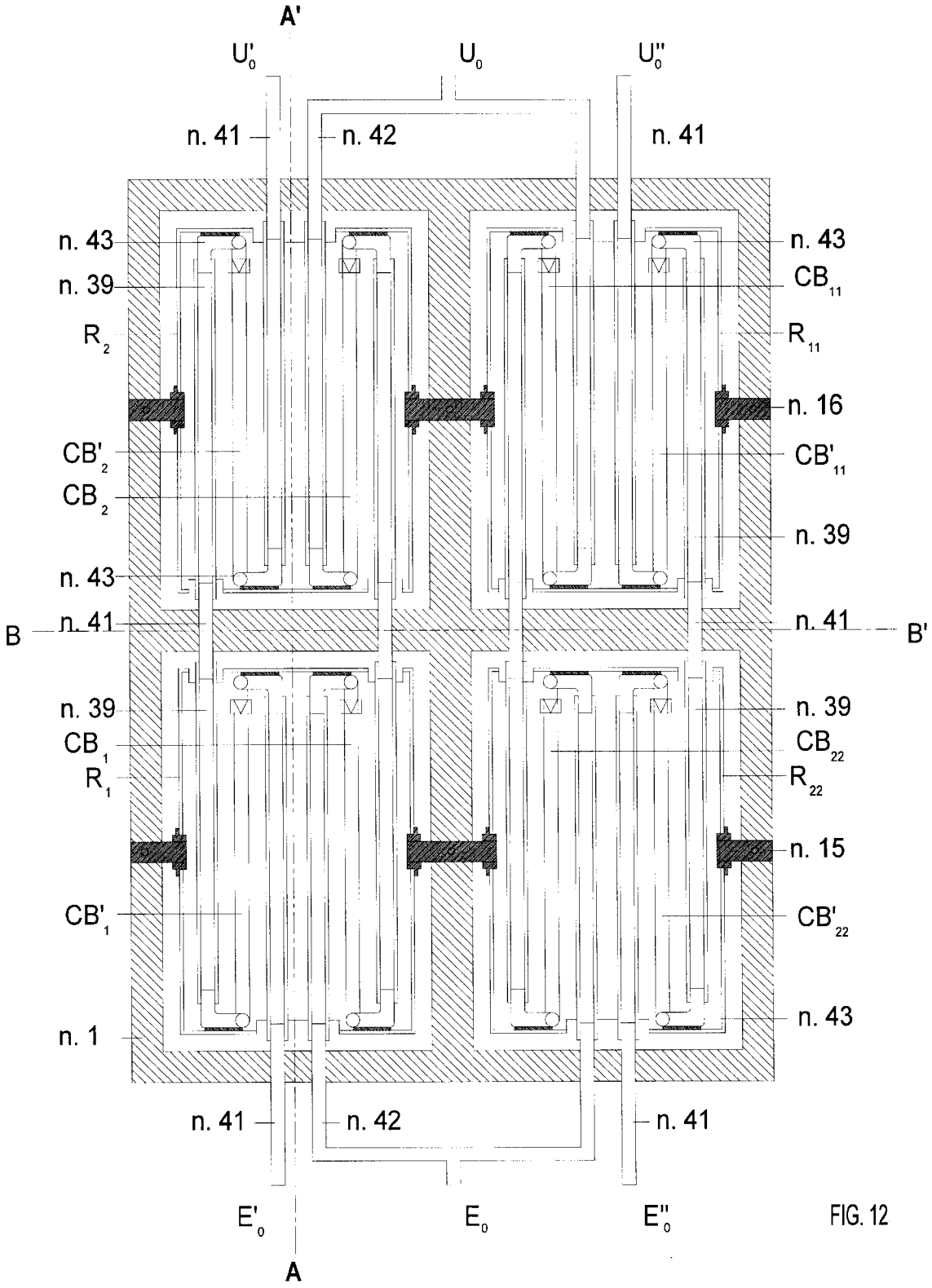

FIG. 12 shows the cross section of a multifunction pump with two parallel rotation shafts executed opposite the plane containing the rotor rotation axes $R_i$ (i=1,11,2,22) and the axes of the connectors 41 and 42 fastened to the frame 1 and on the assumption that for angle θ=0° at which the velocity of rotor $R_1$ is peak said plane also contains the inlet and outlet axes of the connectors 43 fastened to the rotors and aligned in an orderly manner with the axes of the corresponding connectors fastened to the frame 1. This implies the advantage that the stress on the flexible tubes caused by flexure is null for θ=0° and reaches for θ=±90° an identical peak value which represents the smallest possible peak stress. It should be remembered that in the FIG to aid understanding of the drawing, in FIG. 12 all the rotors are shown with identical phase and rotate around the shafts 15 or 16 indicated in the FIGS.

Figure 2:
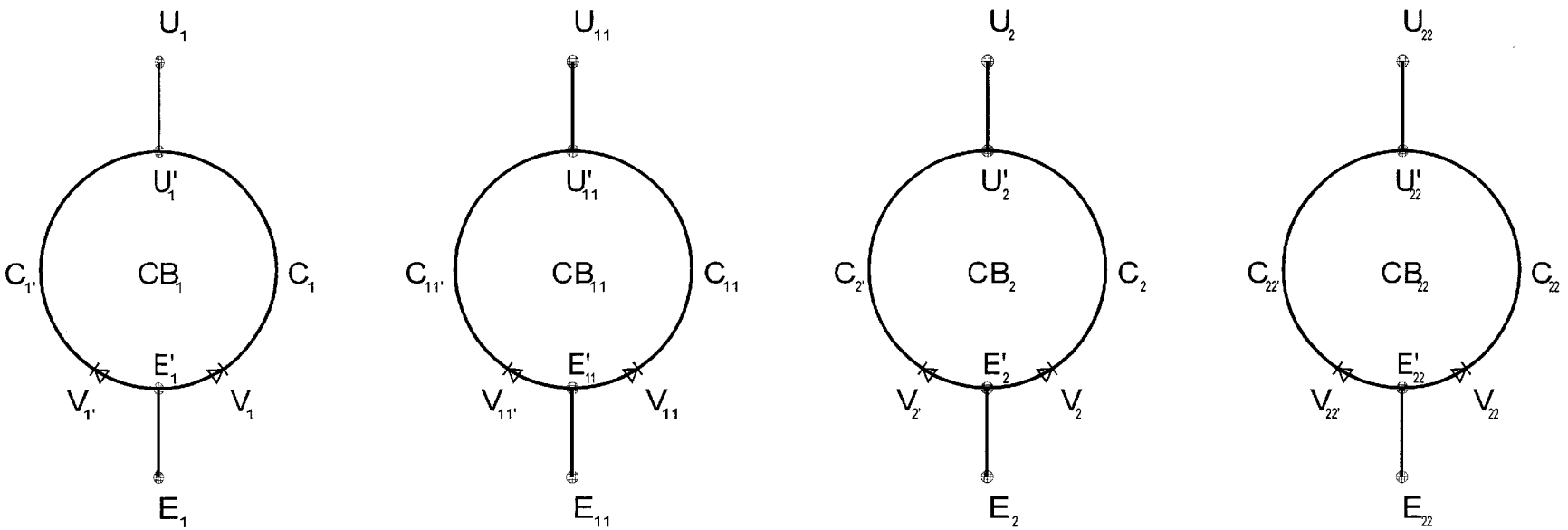
Figure 8:
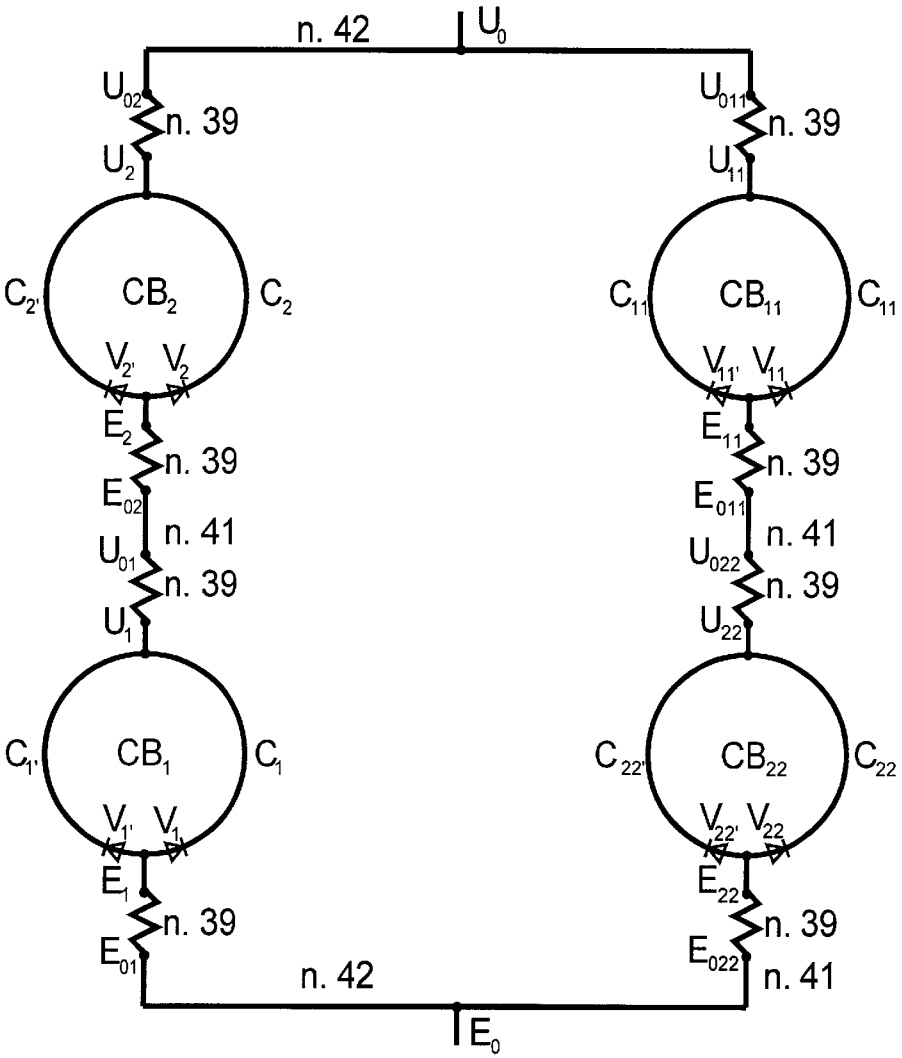

The multifunction pump shown consists of the assemblage of two 2-phase pumps with inlets and outlets ($E'_0$, $U'_0$) and ($E''_0$, $U''_0$) and a 4-phase pump with inlet and outlet ($E_0$, $U_0$). The pumps shown consist altogether of four 2-phase pumps made with the 2-phase circuits shown in FIG. 2. The path of the liquid in the 4-phase pump is identical to that of FIG. 8 while the path of the liquid of the two pumps with inlet and outlet ($E'_0$; $U'_0$) and ($E''_0$; $U''_0$) is identical to that of FIG. 7.

It is noted that, 1) the fixed connectors constrained to the support frame are distributed in the same measure on two opposite sides of the support frame, 2) the axes of the corresponding movable and fixed connectors and of the flexible connecting tube are contained in a plane perpendicular to the rotor rotation axis, 3) the two origins of the two movable inlet and outlet connectors of each 2-phase circuit fastened to a rotor are arranged on a plane belonging to the rotation axis of said rotor and the axis divides the plane in two half planes on one of which is arranged the origin of the inlet connector and on the other the origin of the outlet connector, 4) at rotation angle ϕ=0 (see FIG. 1) the origins of the corresponding fixed connectors constrained to the support frame also belong to said plane, 5) the 2-phase circuits are fastened to the corresponding rotor by welding or other equivalent method, 6) the shafts 15 and 16 were deprived of the part inside the rotors to give more space in the rotor but in special cases it is best to leave them whole, 7) the use of two rotor rotation shafts instead of one gives the advantage that the inlet and outlet of each pump are arranged on two opposites of the support frame.

Figure 13:
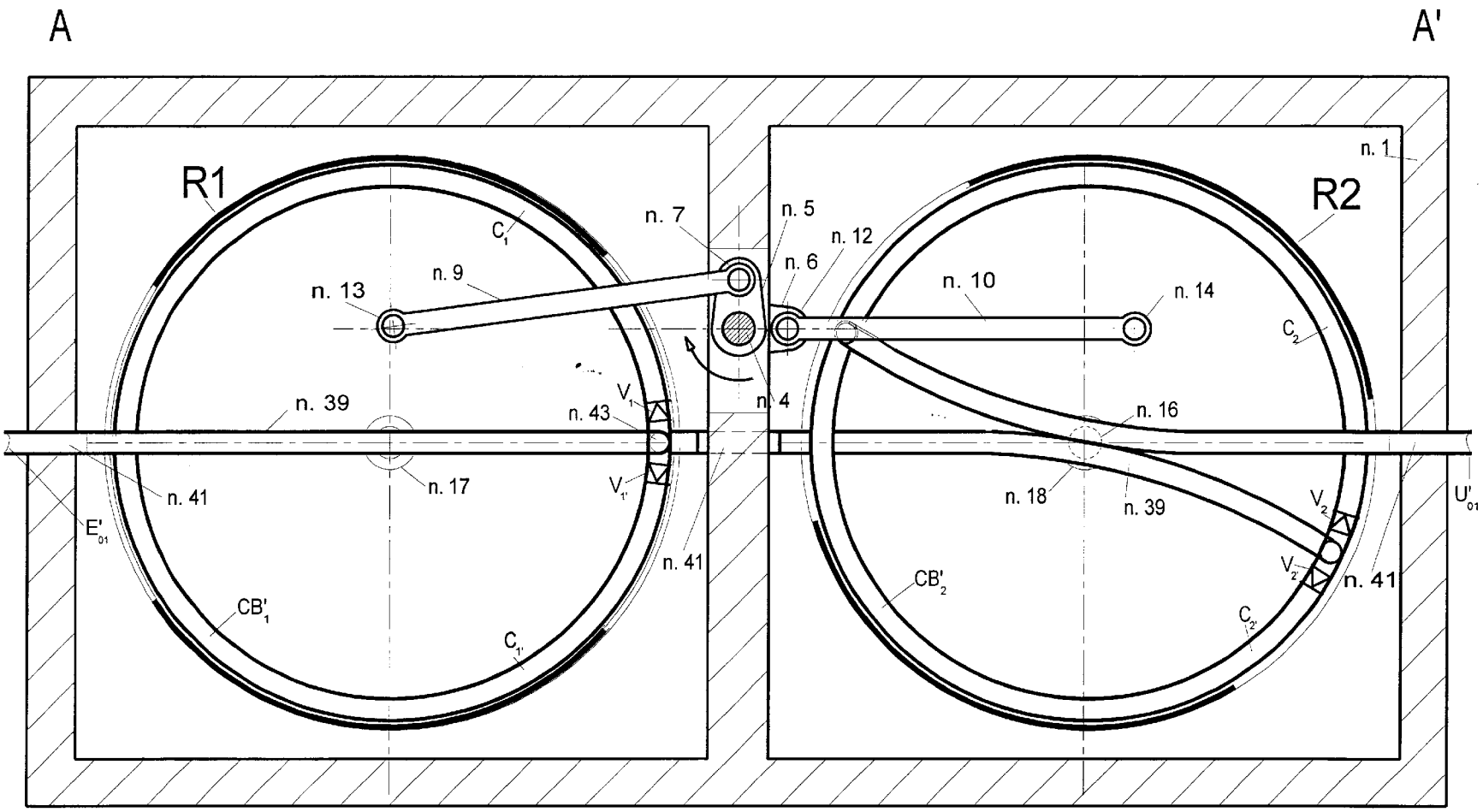

The axis B–B' indicated in the figures belongs to the vertical plane on which is arranged parallel to the axis of the shafts 15 and 16 the axis of the crankshaft 4 which creates the oscillating motion of the rotors as described in FIG. 13.

FIG. 13 shows cross section A–A' indicated in FIG. 12 assuming that the rotation angle of crank 5 is θ=0°. The position of the two 2-phase circuits $CB'_1$ and $CB'_2$ is deduced from the section. The liquid (also see FIG. 12 enters $E'_{01}$, runs through the connector 41 and the flexible tube 39, through a connector 43 feeds the two branches of the 2-phase circuit $CB'_1$ from which it issues into the rear flexible tube 39 not visible in FIG. 13 and enters the connector 41 fastened to the frame whence it continues in the rear flexible tube 39 in peak flexure position fastened to the rotor $R_2$ until it feeds the 2-phase circuit $CB'_2$ whence it issues by means of a connector 43 into a front flexible tube 39 connected to the connector 41 at the end of which is located the pump outlet $U'_{01}$.

In the FIG can also be seen the connecting rod & crank system used for the reciprocating motion of the two rotors. To be seen are the section of the crank shaft 4, the pins 7 and 12 coupled respectively to the big ends of the connecting rods 9 and 10 and the gudgeons 13 and 14 coupled to the small end of the connecting rods 9 e 10 and the openings made in the rotors for the crossing of the flexible tubes and the connecting rods.

It is noted that the FIG. 13 is shown in enlarged scale with respect to FIG. 12 to make clear the details.

Figure 14:
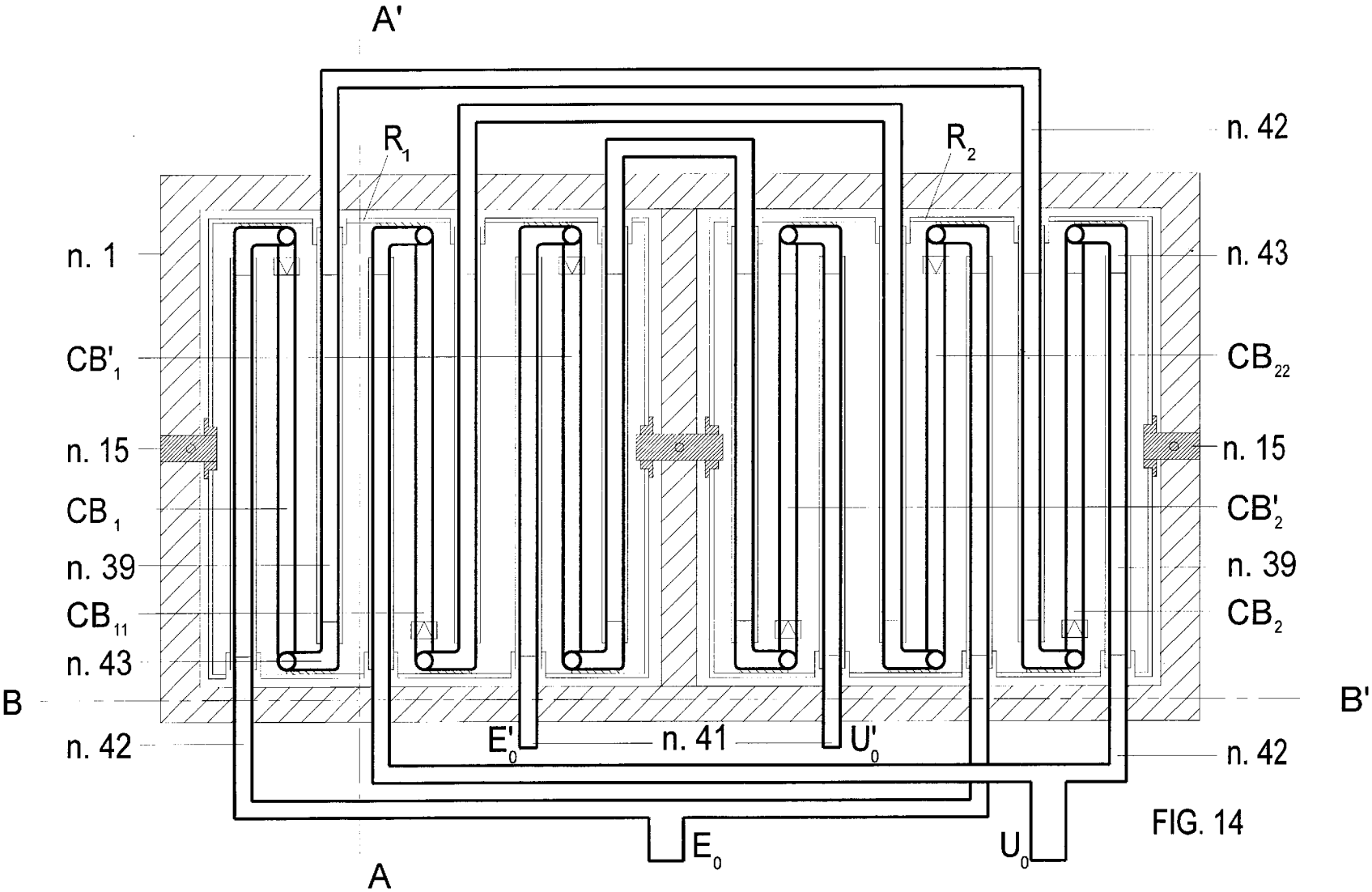

FIG. 14 shows the cross section of a multifunction pump along the plane of the axis 15 of the rotors $R_1$ and $R_2$ and the connectors 41, 42 fastened to the support frame 1. It is assumed that for θ=0° this plane also contains the inlet and outlet axes of the connectors 43 fastened to the rotor $R_1$ and aligned in an orderly manner with the axes of the corresponding connectors fastened to the frame 1. For greater clarity the two rotors are shown with the same rotation angle. The multifunction pump differs from that of FIG. 12 by the fact that the rotors used all rotate around the shafts 15 whose axes are aligned on a single straight line. This requires that the outlet and inlet of each pump be arranged on one side of the support frame.

The multifunction pump shown consists of a 2-phase pump with inlet $E'_0$ and outlet $U'_0$ and a 4-phase pump with inlet E0 and outlet $U_0$.

The inlet $E_0$ is connected to the parallel of the two 2-phase circuits $CB_1$ and $CB_{22}$ whose circuits have a relative inlet phase 0°, 180°, 90°, 270°. The path of the liquid is analogous to that described in FIGS. 7, 8 and 12.

The diagram of FIG. 14 can be advantageous economically because its design is simpler and therefor less costly. Furthermore with only one rotor rotation axis it could be advisable to apply for their oscillating motion the 'guided bearing' system described below.

Figure 15:
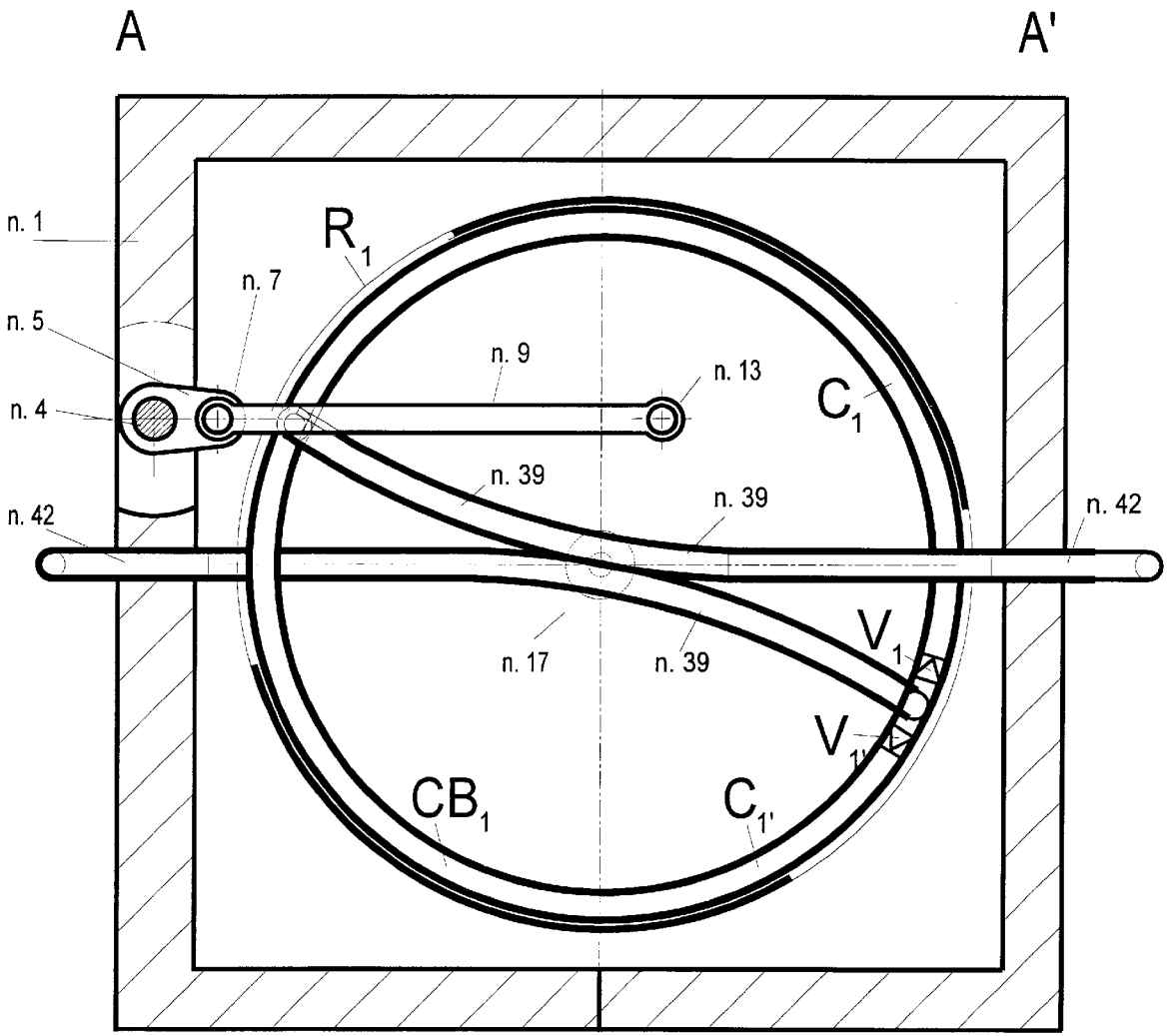

FIG. 15 shows the cross section A–A' indicated in FIG. 14 on the assumption that θ=270° is the angle of the crank 5 on which depends the motion of $R_1$ which at the instant considered has completed the peak rotation $\phi=\phi_0$. There can be seen flexible tube 39 connecting the outlet of the circuit $CB_1$ to the connector 42, the flexible tube connecting the inlet of circuit $CB_1$ to the connector 42, the connecting rod 9 coupled to the crank pin 7 and the gudgeon 13 fastened on $R_1$, the crankshaft 4 and the rotation bearing 17 of $R_1$. In FIG. 15 the axis of the shaft of the two cranks for the motion of the two rotors $R_1$ and $R_2$ is arranged in the cross section B–B' indicated in FIG. 14.

Figure 16B:
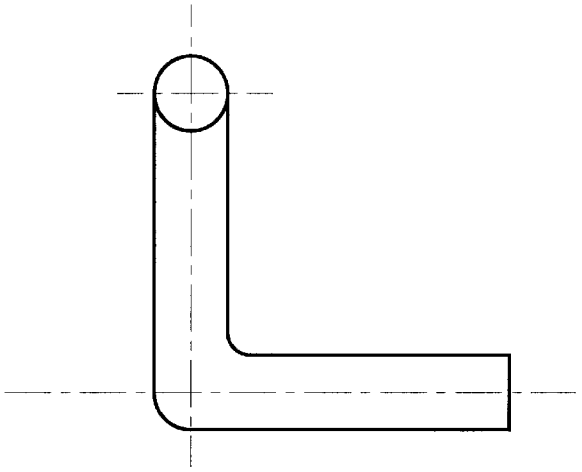
Figure 16A:
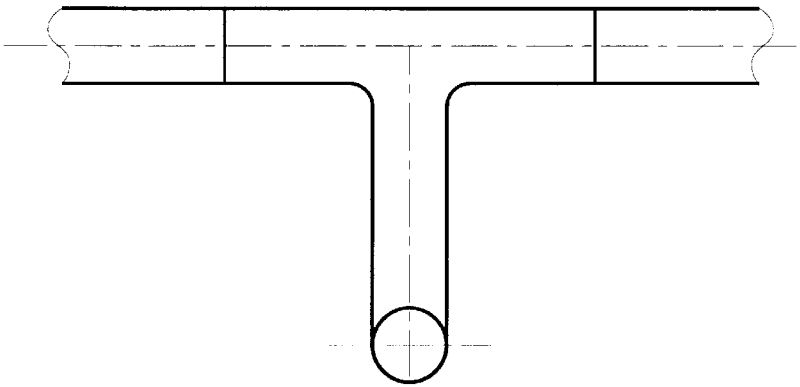

FIG. 16 shows the T connector 43 usable in the 2-phase circuits when the points of $C_i$ and $C_{i'}$ to be connected have a common axis. The vertical axis of the T is the axis of the inlet $E_i$ and the outlet $U_i$ of the 2-phase circuit and is usually bent in a right angle as shown in the FIG to facilitate connection with the connector fastened to the support frame (see FIGS. 12 and 14). The horizontal bar of the T is used for connection of the circuits $C_i$ and $C_{i'}$.

Figure 17B:
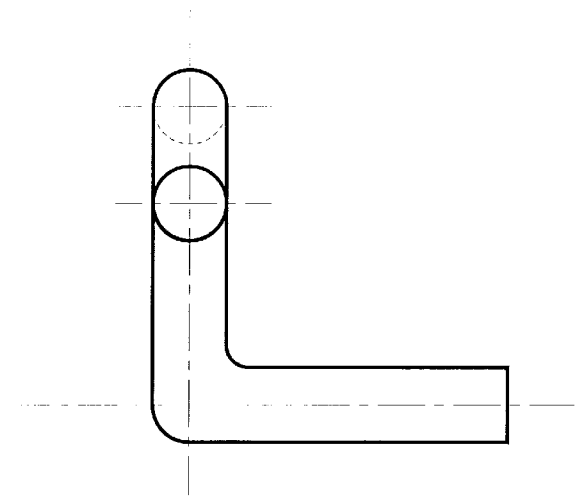
Figure 17A:
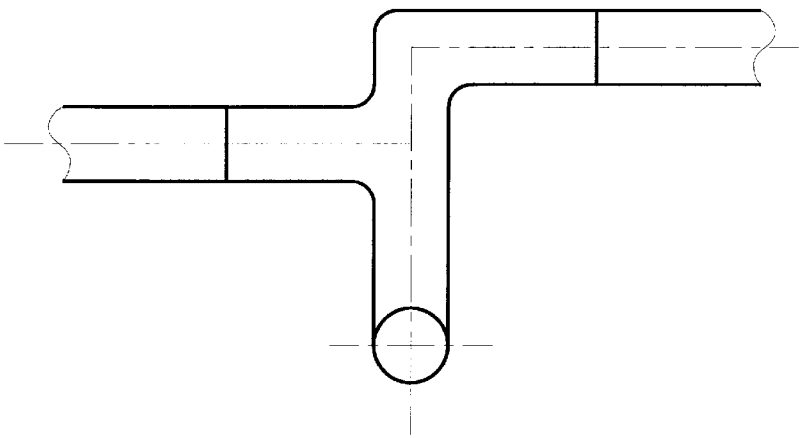

FIG. 17 shows the connector used in the 2-phase circuits when the points of $C_i$ and $C_{i'}$ to be connected belong to two distinct axes of the same circuits. This requires that the horizontal bar of the T be divided in two rods spaced apart in the same measure as the axes of the circuits $C_i$ e $C_{i'}$. The vertical bar of the T has a form identical to that of the connectors of FIG. 16.

Figure 18:
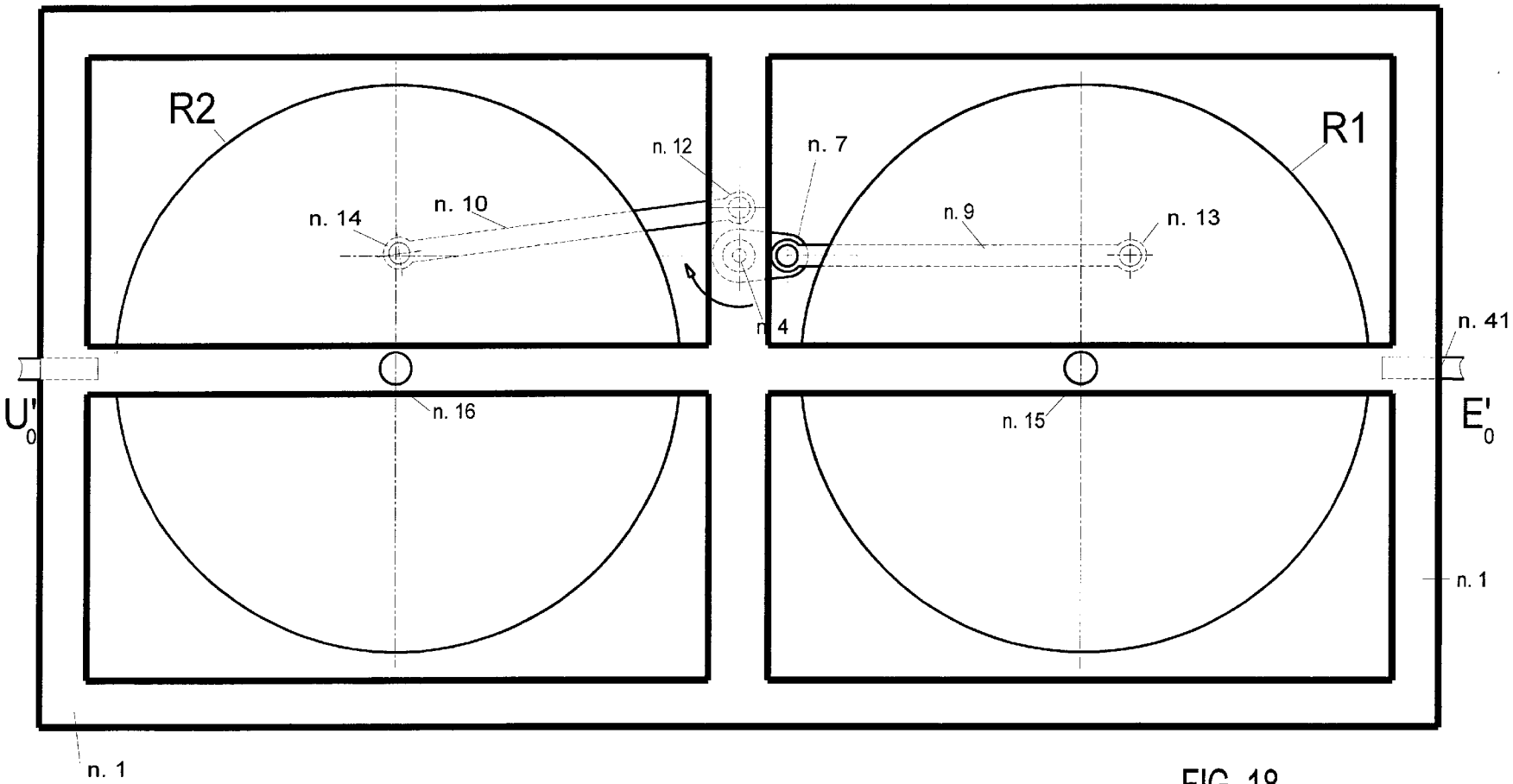

FIG. 18 shows the side elevation of the multifunction pump of FIG. 12. It shows the following components. Support frame 1, rotors $R_1$ and $R_2$, crankshaft 4, part of the connecting rod 9 for the motion of $R_1$, the pin 7 and the gudgeon 13 to which the connecting rod is coupled, part of connecting rod 10 for the motion of $R_2$ and the gudgeon 14 to which it is coupled, the shafts 15 and 16 fastened to the frame 1 and around which rotate respectively the rotors $R_1$ e $R_2$, the inlet $E'_0$ and outlet $U'_0$ of a 2-phase pump which is part of the multifunction pump.

Figure 19:
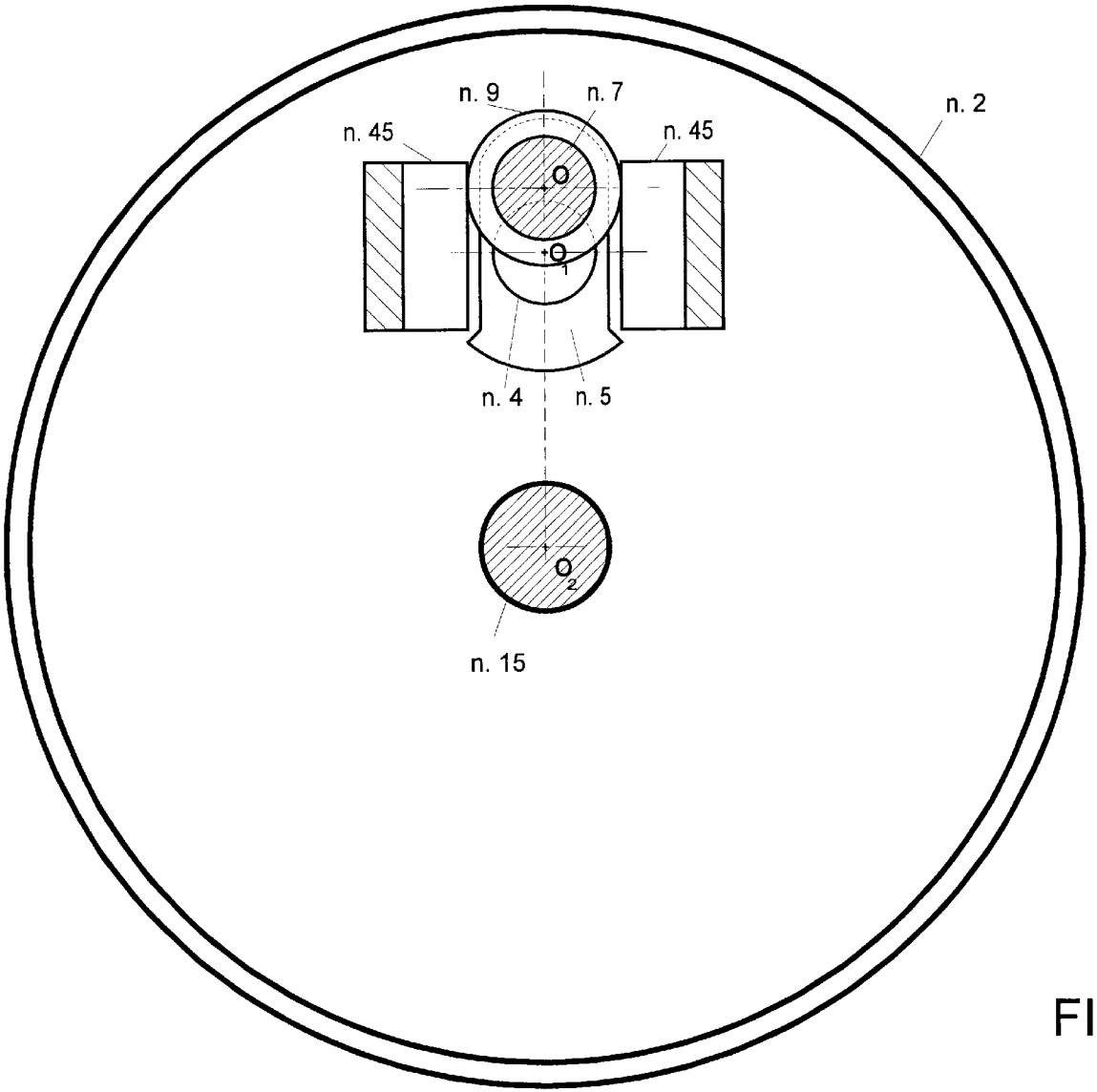

FIG. 19 shows a mechanism designed to convert the rotary motion of a crank shaft rotating on bearings fastened to a support frame in an oscillating motion of a rotor which can oscillate around the shaft 15 fastened to the support frame.

The mechanism consists of, a) the crankshaft 4 with axis parallel to that of the rotation shaft 15 of the rotor 2, b) the pair of crankshafts 5 rotating outside the guides 45 and also having the function of balancing the eccentric counterweights of the bearing 9 and the pin, c) the crankshaft pin 7, d) the bearing 9 applied to the pin 7, and e) the pair of guides 45 with inside surfaces parallel and belonging to two planes equidistant from the rotation axis of the shaft 15. The guides are fastened rigidly to the rotor in its internal part and between them is arranged with close tolerance the external ring of the bearing 9. Everything is arranged in such a manner that that by rotating the shaft 4 the bearing rotates alternately on one of the guides to cause oscillating motion of the rotor.

B.1) Single Active Circuits

The purpose of the single active circuits is to generate in the contained liquid the necessary pressure differential for pump operation. This justifies the term of active circuit attributed to them. They are made up of a tube with circular or rectangular cross section. Their axis is bent in a curve which can be a section of circumference or cylindrical spiral or Archimedean spiral.

The active circuits considered in the description below are the four left-hand circuits $C_i$ where i=1,11,2,22 and the four right-hand circuits $C_{i'}$ where i'=1',11',2',22'. The circuits $C_i$ and $C_{i'}$ have their liquid inlet and outlet indicated respectively by $E'_i$, $U'_i$ and $E'_{i'}$, $U'_{i'}$.

The circuits $C_i$ and $C_{i'}$ are to be considered respectively left-hand and right-hand because the travel direction from their inlet to their outlet is respectively left-hand and right-hand. Travel direction is determined in relation to the versor $\bar{c}$ of the normal of their common support plane. At the inlet of each circuit $C_i$ and $C_{i'}$ are arranged the one-way valves with allowed direction from inlet to outlet indicated respectively by $V_i$ and $V_{i'}$. These consist of e.g. a closing disk guided by a central axis and have the purpose of allowing inlet of the liquid and preventing its outlet.

The eight active circuits are distributed on various rotors termed pertinent rotors in accordance with the following diagram:

| Circuits | Pertinent rotor |
|---|---|
| $C_1$, $C_{1'}$ | $R_1$ with relative phase θ = 0° |
| $C_2$, $C_{2'}$ | $R_2$ with relative phase θ = 90° |
| $C_{11}$, $C_{11'}$ | $R_{11}$ with relative phase θ = 180° or $R_1$ in the absence of $R_{11}$ |
| $C_{22}$, $C_{22'}$ | $R_{22}$ with relative phase θ = 270° or $R_2$ in the absence of $R_{22}$ |

The active circuits develop useful pressure in the liquid by means of rotational inertial forces generated by angular accelerations. For this purpose they are rigidly fastened on rotors on which is imposed a periodic oscillatory motion around their rotation axis which coincides with the axis z of a Cartesian reference system (0, xyz) with axes oriented respectively by the versors $\bar{a}$,$\bar{b}$,$\bar{c}$.

The fastening of each circuit takes place, 1) in such a manner that the area $S_0$ of its projection on the plane (0,x,y) is peaks as defined by the relationship $$S_o = 1/2 \int_s \bar{c} \times r \cdot \bar{t}_1 \, ds$$

which represents the integral along the longitudinal and barycentric axis s of the circuit whose member ds has tangent with versor $\bar{t}_1$ and radius vector $\bar{r}$, and 2) so that the path along the axes s of the circuit in the direction allowed by the valve placed at the circuit inlet is counterclockwise with respect to the versor $\bar{c}$ for the circuit $C_i$ and clockwise for the circuit $C_{i'}$.

The active circuits $C_1$, $C_{11}$, $C_{1'}$, $C_{11'}$ are mounted on the rotor $R_1$, while $C_2$, $C_{2'}$, $C_{22}$, $C_{22'}$, are mounted on the rotor $R_2$. For pumps with limited requirements the active circuits $C_{11}$, $C_{11'}$, $C_{22}$, $C_{22'}$ can be absent while in special cases the active circuits can be mounted on four rotors $R_1$, $R_2$, $R_{11}$, $R_{22}$ in the following manner: $C_1$ and $C_{1'}$ on $R_1$, $C_2$ and $C_{2'}$ on $R_2$, $C_{11}$ and $C_{11'}$ on $R_{11}$, $C_{22}$ and $C_{22'}$ on $R_{22}$. In this case the angle θ of the respective cranks has in an orderly manner the relative value θ=0°, 90°, 180°, 270°.

The rotors (see FIG. 12) rotate around the parallel axes of the shafts 15 and 16 fastened to the support frame. The shafts 15 and 16 lack a central part to allow space for the flexible tubes. In the absence of the shaft 16 all the rotors are mounted on the shaft 15 (see FIG. 14).

The presence of the shaft 16 is especially useful for high power and flow pumps or multifunction pumps with cumbersome 2-phase circuits also to enable determining the required ratio of length to width of the support frame. By using the shaft 16 it is also possible to make the series of two 2-phase circuits to avoid the U connectors and associated losses.

The motion of the rotors mounted on the shafts 15 and 16 is brought about by means of a single shaft equipped with four cranks of identical radius and relative phase 0°, 90°, 180°, 270°0 coupled to four identical connecting rods whose small end is coupled to a gudgeon fastened to a rotor. The gudgeon axis has the same radius in all rotors. The distance of the rotation axis of each rotor from the crankshaft rotation axis is also identical. Accordingly the motion of the rotors differs only in the phase.

The rotors are subjected to a periodic oscillatory motion around their rotation axis by a connecting rod & crank system as described above in FIG. 1 or by an equivalent system as proposed below.

Figure 1:
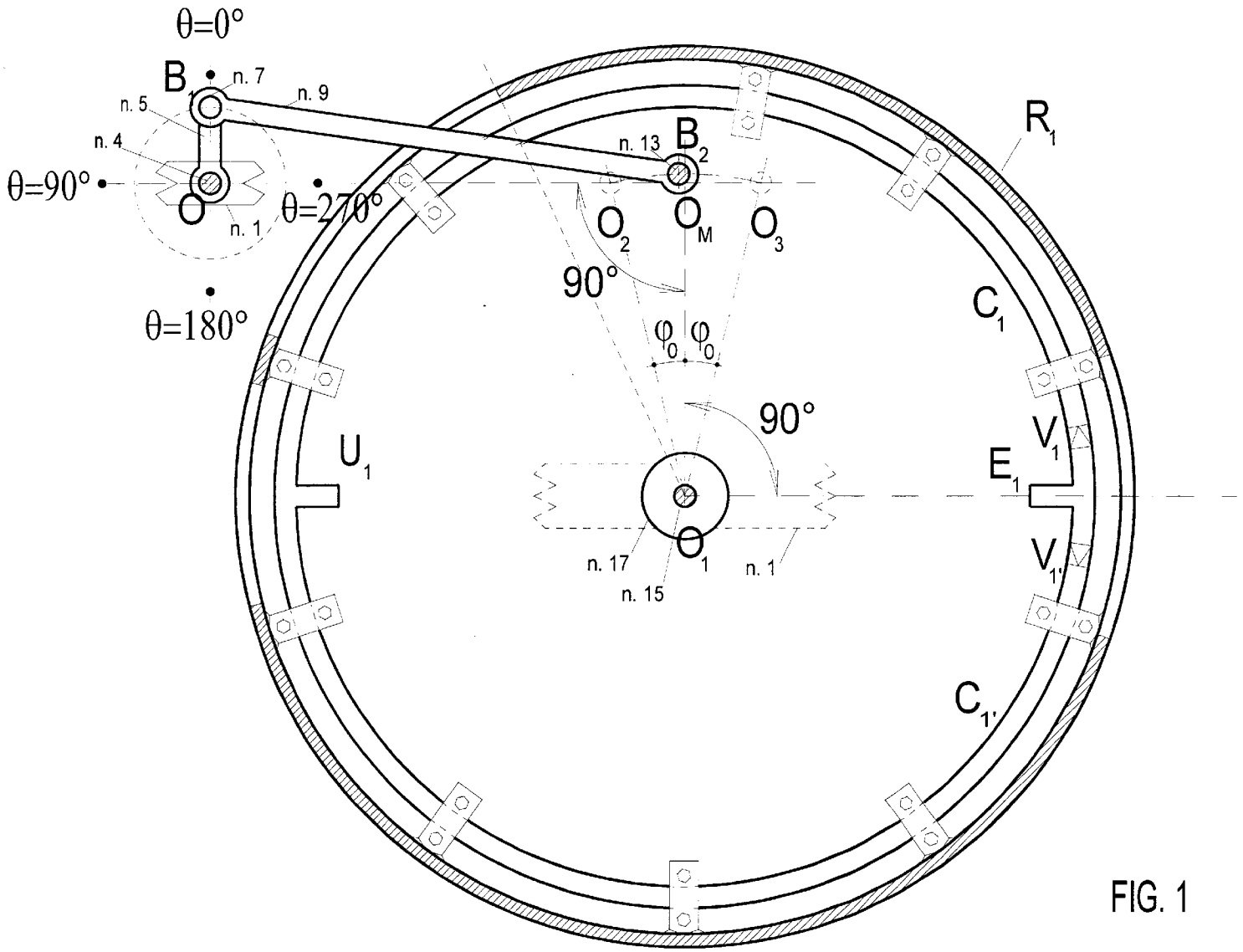

Calculation of the motion of the system with four bars $OB_1$, $B_1B_2$, $B_2O_1$, $O_1O$ shown in FIG. 1 is complicated and its results are not immediately interpretable. Therefore on the assumption that $\dot{\theta}$ is constant the oscillating motion of the rotor $R_1$ is assumed as described by the following equations:

$$\phi=\phi_0 \text{ sen } \theta$$

$$\dot{\phi}=\phi_0\dot{\theta} \cos \theta$$

$$\phi=-\phi_{0\theta}^2 \text{ sen } \theta$$

where $\phi_0$ is the absolute value of the peak right or left angular shift of the rotor and $\theta$ is the crank rotation angle.

In FIG. 1 the points 0, $O_2$, $O_3$ belong to a straight line perpendicular to the straight line $O_1O_M$, where $O_M$ is the mean point of the segment $O_2O_3$. The points $O_2$ and $O_3$ are the end points of the path of the axis of the connecting rod small end opposite which the highest rotor accelerations take place.

As a result the liquid mass of the circuit $C_i$ is subject to an inertial force increasing from $E'_i$ to $U'_{i'}$ whose highest instantaneous value in the section $U_i$ is expressed by:

$$f_i=-2\rho S_c S_0\ddot{\phi}=2\rho S_c S_0\phi\dot{\theta}^2 \text{ sen } \theta$$

to which corresponds a pressure differential between the sections $E'_i$ and $U'_i$ $$p_{Gi}=2\rho S_o\phi_o^{\theta^2} \text{ sen } \theta$$

For $\phi_o°<10°$, a value not exceeding the majority of applications, the error contained in the above equations is amply tolerable for machine set-up calculation. Accordingly the simplifying equations written above are considered valid for the purposes of the present description and will be constantly used in all the following parts.

B.2) The Active 2-Phase Circuit

Use of the 2-phase circuit has the purpose of, 1) developing in the range $\theta$ (0°, 360°) a useful pressure differential with constant sign and continuous in the liquid included between the outlet and inlet sections $U_i$ and $E_i$ utilizing both the phases of opposite sign of the acceleration of the rotor to which the 2-phase circuit is fastened; the qualification '2-phase' attributed to the circuit derives therefrom; and 2) developing in both the above mentioned phases a continuous liquid flow of constant sign.

From the four identical pairs of circuits ($C_1$; $C_{1'}$), ($C_{11}$; $C_{11'}$), ($C_2$; $C_{2'}$) $C_{22}$; $C_{22'}$) are taken four 2-phase circuits (see FIG. 2) in the following manner.

Putting the two inlets $E'_i$ and $E'_{i'}$ and two outlets $U'_i$ and $U'_{i'}$ of each circuit pair in communication where i=1, 11,2,22, branching the inlet $E_i$ at the connection of $E'_i$ and $E'_{i'}$ and the outlet $U_i$ at the connection of $U'_i$ with $U'_{i'}$, and inserting immediately after the inlets E'i and E'i' the directional valves Vi and Vi' with allowed direction from the inlet to the outlet of the liquid.

In view of the above the 2-phase circuit consists of the parallel of a right-hand circuit $C_{i'}$ with an identical left-hand circuit $C_i$ of area $S_0$ and both equipped with a directional valve allowing the liquid only the inlet to outlet path. Considering this the forces and velocities directed from inlet to outlet will be indicated as positive.

In the range $\theta$ (0°; 180°) (see FIG. 9) the negative acceleration of the rotor $R_1$ is transmitted to the liquid of the circuit $C_1$ in which it generates an inertial force $f_1=2\rho S_c S_o\phi_{o\theta}^2$ sen $\theta>0$ which, 1) establishes between the sections $U_1$ and $E_1$ the pressure differential $f_1/S_c$, 2) causes in the liquid of $C_1$ a positive velocity, and 3) forms with the equal and opposite force $f_1$. a resultant which tends to annul the velocity of the liquid of the circuit $C_1$' developed in the latter from $f_1$' at $\theta$ (180°; 360°).

In the range $\theta$ (180°; 360°) the force $f_{1'}>0$: 1) develops between the sections $U_1$ and $E_1$ the pressure differential $P_{G1'}$ analogous to $P_{G1}$, 2) develops in the liquid of $C_{1'}$ a positive velocity, and 3) forms with the negative force $f_1$ a resultant which tends to annul the velocity of the liquid in the circuit $C_1$.

In view of the foregoing it can be stated that excluding the other forces present the 2-phase circuit $CB_1$ in the range $\theta$ (0°; 360°), 1) establishes between the sections $U_1$ and $E_1$ a positive pressure differential $P_G=2_\rho S_o\phi_{o\theta}^2|\text{sen } \theta|$ ends excluded where $|\text{sen } \theta|$ is the absolute value of sen $\theta$ and its behavior is identical to that of FIG. 9, 2) establishes in the liquid of the circuit $C_1$ a flow with minimum value of $\theta$=0° and peak value of $\theta$=180°, 3) establishes in the liquid of the circuit $C_{1'}$ a flow with minimum value for $\theta$=180° and peak value for $\theta$=360°, and 4) establishes between the sections $U_1$ and $E_1$ a flow equal to the sum of the flows of the circuits $C_1$ and $C_{1'}$.

The other 2-phase circuits $CB_{11}$, $CB_2$ and $CB_{22}$ display analogous behavior in the respective pertinent ranges.

B.3) Embodiment of the 2-Phase Circuits

Figure 3:
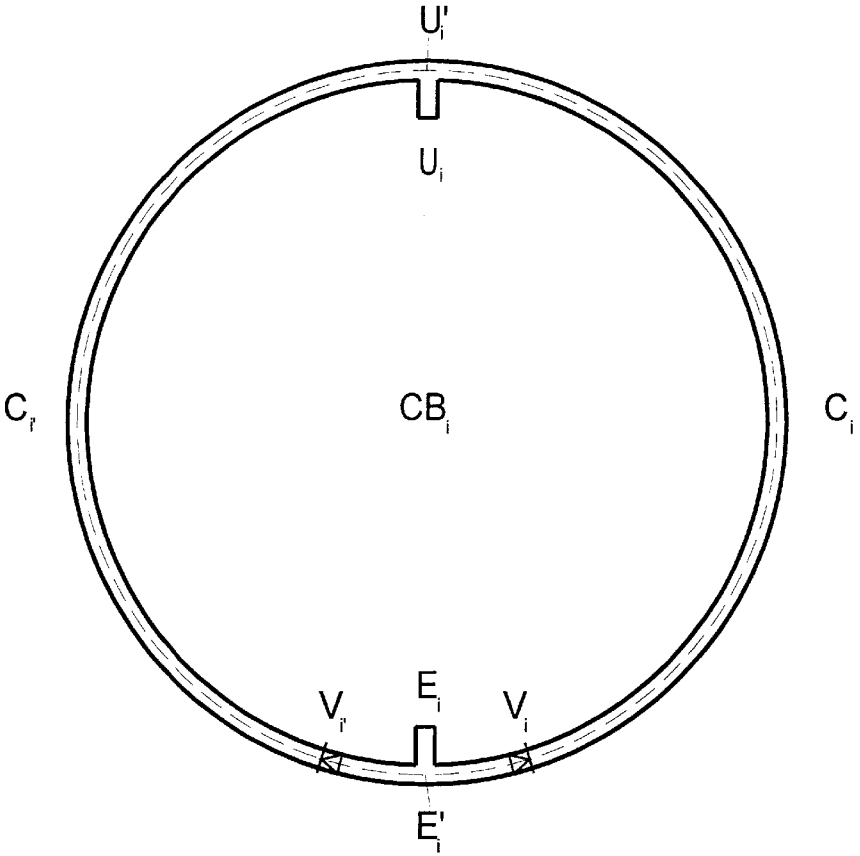

The 2-phase circuits can be provided in various ways among which are those explained below in paragraphs a), b), c), d) and e).

a) The 2-phase circuit $CB_i$ whose circuits $C_i$ and $C_{i'}$ are made from a tube bent along a circumference (see FIGS. 1, 3) from which 43 the inlet $E_i$ and outlet $U_i$ are branched with the connectors in diametrically opposite position. The valves $V_i$ and $V_{i'}$ are applied to the circuits $C_i$ and $C_{i'}$ at the inlet. The circuit displays the following advantages. 1) At all points of its axis the versor of the tangent coincides with the versor of the inertial force developed in the liquid which is proportionate to the distance from the rotation axis at all points; this limits hydraulic losses and allows the liquid mass contained in the circuit to offer the greatest possible contribution for pump operation; 2) it has reduced radial and axial dimensions; if the section is rectangular the dimensions are represented by that of a cylindrical ring whose section can be varied in height and width depending on requirements while holding its area constant; and 3) the circuit is simpler than any other so that it has relatively low construction costs.

Figure 4:
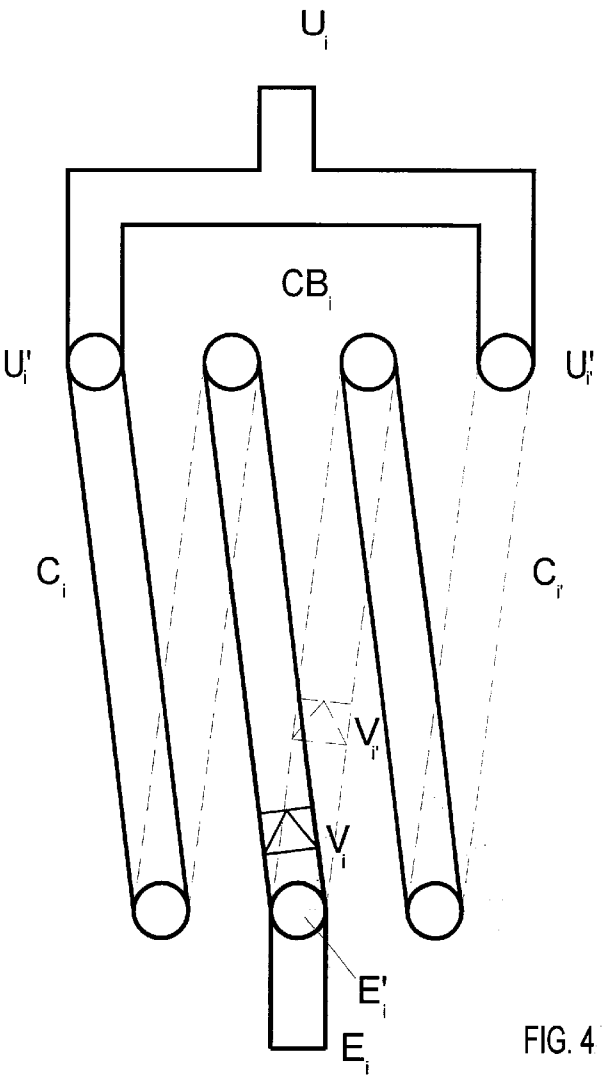

The circuit is especially suited for hydroelectric plants and more generally pumps with flows of any size and relatively low pressures.

b) 2-phase circuit with circuits $C_i$ and $C_{i'}$ made from a tube whose axis is bent in accordance with a cylindrical spiral (see FIG. 4 and description). The inlet $E_i$ is branched at the mean point of the winding and opposite are arranged the two directional valves oriented towards the outlet. The outlet $U_i$ is branched at the point of junction of its two end points. In this manner there is obtained from the inlet $E'_i$ to the outlet $U'_{i'}$ a right-hand circuit $C_{i'}$ and from $E'_i$ to $U'_i$ a left-hand circuit $C_i$. The drawing makes clear the advantage of using for each component circuit a number of turns $n_s$=0,5+K where K is a whole number in order to have inlet $E_i$ and outlet $U_i$ of the $CB_i$ arranged in a position analogous to that described for FIG. 4. The cylindrical spiral winding has a high dimension along the axis z but it has the advantage of a small radial dimension. It is noted that the winding turns must be tight.

c) 2-phase circuit with active circuits consisting of a tube bent in an odd number of superimposed cylindrical spiral sections.

The tightly wound turns of two immediately superimposed sections are wound with reference to a versor parallel to their axis with identical rotation direction. In this manner the inertial forces applied to the liquid contained in each section are added together with identical sign. The sections are arranged in such a manner that the terminal section of each intermediate section also belongs to the initial section of the section immediately above to be wound with opposite advancement direction but with identical rotation direction. The number of sections is odd and each has a number of turns $n_s$=K+0,5 where K is a whole number.

The two circuits $C_i$ and $C_{i'}$ are identical. One of these is rotated 180° around an axis perpendicular to the axis of the helix and placed side-by-side along a same axis common to the other circuit so that the two terminal sections from which the inlet (or outlet) of the 2-phase circuit is branched are contiguous. The outlet (or inlet) is branched from the connecting tube of the two sections which after overturning are wound in end positions as described for FIG. 4. The valves are inserted with allowed direction towards the outlet immediately after the inlet.

Figure 5:
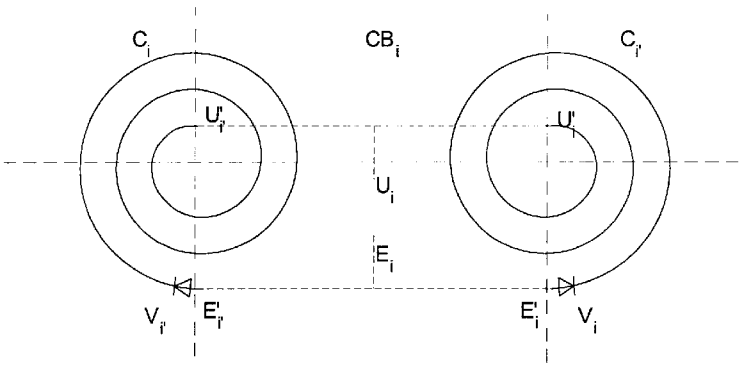

The 2-phase circuit described has the advantage of reaching a large number of turns and utilizing all the available space. It is especially useful for pumps with very high pressure and low flow.

d) 2-phase circuit with circuits $C_i$ and $C_{i'}$ consisting of two identical sections of tube whose axis is bent in an Archimedean spiral. Its purpose is to provide a 2-phase circuit suitable for a broad range of flows and pressures from low to high with a very limited axial dimension. It is also suitable for construction of the multiple pumps below. It is built in the following manner (see FIG. 5 and description):

two tubes are bent in two identical sections of an Archimedean spiral so that the outer surface of a turn adheres to the internal surface of the following turn; the number of turns of each section must be $n_s$=0,5+K where K=whole number;

the supporting plane of one of the two sections is overturned so as to obtain a left-hand circuit $C_i$ and a right-hand circuit $C_{i'}$ starting from the inlet $E_i$;

the circuits $C_i$ and $C_{i'}$ are superimposed so that the sections of the two pairs ($E'_i$, $E'_{i'}$) and ($U'_i$, $U'_{i'}$) are contiguous; the one-way valves $V_i$ and $V_i'$ are applied to the inlets $E'_i$ and $E'_{i'}$;

the inlet $E_i$ is branched from the inlets $E'_i$ and $E'_i$ and the outlet $U_i$ from the outlets $U'_i$ and $U'_{i'}$ with the connectors 44 as seen in FIG. 17); these are arranged as described for FIG. 4).

e) 2-phase circuit with component circuits $C_i$ and $C_{i'}$ consisting of an odd number $n_T$ of identical tube sections whose axis is bent along an Archimedean spiral with a number of turns $n_s$=K+0,5 where K is a whole number. The active component circuits have a large area $S_0$ and therefore the pump is suited for developing pressures between a mean value and a very high value with small to medium flows.

Figure 6:
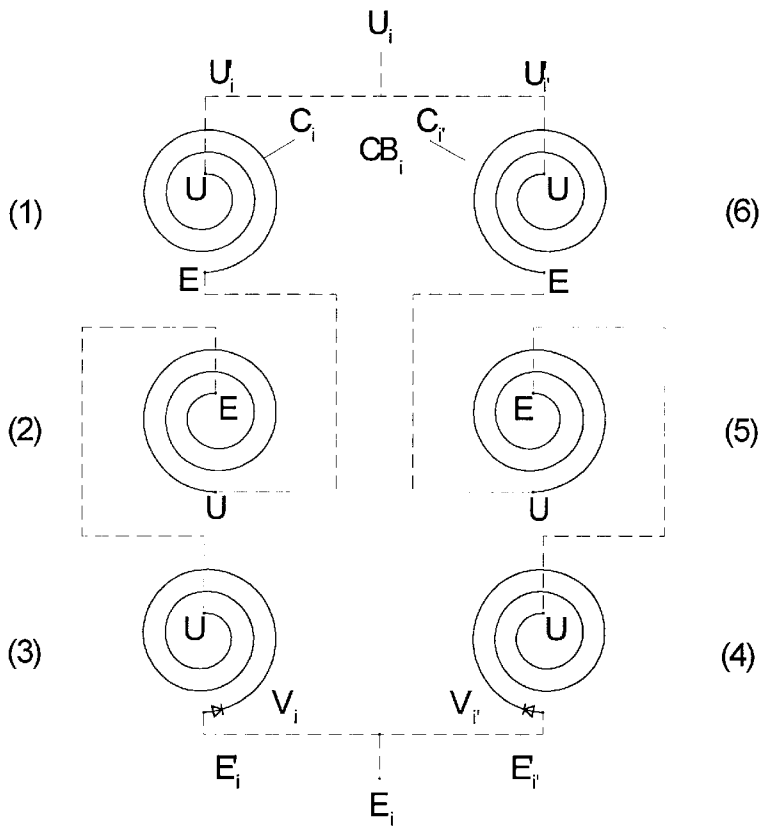

The 2-phase circuit has the following characteristics (see also FIG. 6 and description):

1 The axes of the sections of circuits $C_i$ and $C_{i'}$ are wound from the inlet $E'_i$ to the outlet $U'_i$ with radius alternately increasing and decreasing with the increase in the winding angle; the direction of this is left-hand for the sections of $C_i$ and right-hand for the sections of $C_{i'}$ with reference to the versor $\bar{c}$ of the normal to the common support plane;

2 The component sections of $C_i$ and $C_{i'}$ connected with a broken line for greater clarity in FIG. 6 must be superimposed in an orderly manner in the order 1,2,3, 4,5,6 indicated in FIG. 6 without being rotated and so that all the points E and U indicated in FIG. 6 are contiguous; in addition the component sections are to be connected at the E and U points which are contiguous after the last operation; the inlet $E_i$ and outlet $U_i$ of the $CB_i$ are branched from the connection of the pairs ($E'_i$, $E'_{i'}$) and ($U'_i$, $U'_{i'}$) and are arranged in a manner analogous to that described for FIG. 4;

3 The total number $n_{ts}$ of spirals of the each circuit $C_i$ and $C_{i'}$ in view of the above is $n_{ts}=n_s x n_T$; with the increase of $n_s$ the radial dimension of the circuit increases and with the increase of $n_T$ the axial dimension increases; in addition $n_s$ and $n_T$ can be changed to make full use of the available space.

C.1) The 2-Phase Pump

The 2-phase pump consists of two 2-phase circuits $CB_1$ and $CB_2$ connected in series and fastened with the described methods respectively to the rotors $R_1$ and $R_2$ which are subjected to periodic acceleration of identical frequency and with relative phase θ=0°, 90°. The inertial forces $f_1$ and $f_{1'}$ generated by the 2-phase circuit $CB_1$ located at the pump inlet act with the two relative phases 0° and 180° of the angle θ; the term 2-phase attributed to the pump derives therefrom.

The series of the two 2-phase circuits makes it possible to obtain a pump with minimum generated pressure equal to the peak pressure developed by each of the two component 2-phase circuits so as to allow application to the pump of a useful counterpressure adequate for the requirements, a discharge free from breaks and one-way valves constantly open. The series also allows self-regulation of the flows of the internal circuits so that it will have periodic behavior.

Figure 7:
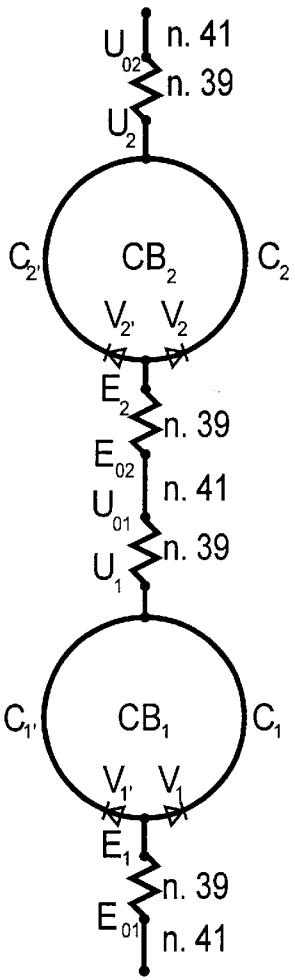

The series of two circuits is shown in FIG. 7 and explained in the associated description. It is also useful to examine the FIGS. 12 and 14 which show the arrangement proposed for a 2-phase pump with inlet $E'_0$ and outlet $U'_0$.

In the range θ (0°; 360°) the circuits $C_1$ and $C_{1'}$ of $CB_1$ generate in the liquid respectively the following inertial forces:

$f_1=F_0$ sen θ positive at θ (0°; 180°) and negative at θ (180°; 360°); and $f_{1'}=-F_0$ sen θ positive at θ (180°; 360°) and negative at θ (0°; 180°); in them it is $F_0=2\rho S_o S_c \phi_{o\theta}^2$ which shows the peak value of $f_1$ and $f_{1'}$ at the outlet $U_1$ (see FIG. 7).

In addition for each angle θ the relationship $f_1+f_{1'}=0$ applies and therefore the absolute values satisfy $|f_1|=|f_{1'}|$.

In θ (0°; 360°) the circuits $C_2$ and $C_{2'}$ di $CB_2$ generate in the liquid respectively the following inertial forces:

$f_2=F_0$ sen(θ+90°) positive at θ (90°; 27°) and negative at θ (−90°; +90°); in addition $f_{2'}=-F_0$ sen(θ+90°) negative at θ (90°; 270°) and positive at θ (−90°; +90°);

For each θ the relationships f2+f2=0 and |f2|=|f2'| apply.

In view of the foregoing at each angle θ of the range θ (0°; 360°) each 2-phase circuit generates in the liquid contained a positive inertial force whose sum at the end $U_2$ of the series of the two 2-phase circuits is equal to the resultant (see FIG. 11):

$$R_G=|f_1|+|f_2|=F_0(|\text{sen}\ \theta|+|\cos\ \theta|).$$

To the resultant $R_G$ corresponds the instantaneous value of the pressure differential $p_G$ generated between the inlet $E_{01}$ and the outlet $U_{02}$ of the pump expressed by:

$$p_G=[|f_1|+|f_2|]/S_c=2\rho S_o\phi_{o\theta}^2(|\text{sen}\ \theta|+|\cos\ \theta|).$$

This has the peak value $p_{Gmax}=2\sqrt{2}\rho S_o\phi_{o\theta}^2$, the minimum value $p_{Gmin}=2\rho S_o\phi_{o\theta}^2$ and the mean value $$p_{Go}=\frac{8}{\pi}\rho S_o\varphi_{o\theta}^2)$$

At normal pump operating speed forces appear which change the trend of the above mentioned diagrams. Specifically in the range θ ($\theta_o$; 180°−$\theta_o$) indicated as PHASE I of the operation of the circuit $C_1$ to the mass of the liquid contained in the series consisting of circuits $C_1$ and $CB_2$ stressed by a positive force is applied the positive resultant:

$$R_I=R_{I(1)}+R_{I(2)},$$

in which

1 $R_{I(1)}=2f_1+|f_2|-p_H S_c$, applies at θ ($\theta_o$; 0°) and at −θ (180°; 180°−$\theta_o$) where $\theta_o$ is a negative angle; in addition 2 $R_{I(2)}=f_1+|f_2|-p_H S_c$, applies at θ (0°; 180°)

In the foregoing relationships $|f_2|$ is the absolute value of $f_2$ and $p_H=p_s+p_{cs}+p_e$ in which $p_s$ is the useful counterpressure $p_{cs}$ is the pressure loss in the series of two active circuits $C_1$ and $C_2$ and $p_e$ is the pressure loss in the circuits external to active circuits.

The above mentioned resultant takes the velocity of the liquid of the circuit $C_1$ from a value null for θ=+$\theta_o$ to a peak value for θ=180°−$\theta_o$.

In the next range θ (180°−$\theta_o$, 360°+$\theta_o$) indicated as PHASE II of the operation of $C_1$ the above mentioned mass is stressed by a negative resultant $R_{II}$ expressed by $R_{II}=2f_1+|f_2|-p_H S_c$ which returns the peak speed of the liquid of $C_1$ to a value null for θ=360°+$\theta_o$.

The same observations can be repeated for the mass of the liquid of the series of the circuits $C_1$, and $CB_2$ stressed by a positive inertial force.

In PHASE I of the operation of $C_{1'}$ for the range θ (180°+$\theta_o$; 360°−$\theta_o$) the velocity of the liquid di $C_{1'}$ is taken by a positive resultant analogous to the above from a value null for θ=180°+$\theta_o$ to a peak value for θ=360°−$\theta_o$) equal to that for the circuit $C_1$ while in PHASE II of the operation di $C_{1'}$ a negative resultant analogous to the above in the range θ (−$\theta_o$; 180°+$\theta_o$) takes the velocity of the liquid from said peak value back to a value null.

The velocity of the liquid of $C_1$ has periodic behavior. The periodicity condition is reached when the velocity of the liquid at the beginning of PHASE I is identical to the velocity of the same liquid corresponding to the end of PHASE II. The condition is satisfied when $p_H=F_o/\pi S_c$. The circuit $C_{1'}$ has analogous behavior. The system tends independently to reach and maintain the dynamic equilibrium situation because with each variation in liquid velocity the terms $p_{cs}$ and $p_e$ of which $p_H$ is composed also vary in the same manner.

At normal operating speed the one-way valves are always open in the presence of $f_i<0$ where i=1, 1', 2, 2' which decelerate the liquid column in motion from $E_i$ to $U_i$ and accordingly establish therein an overpressure decreasing from $U_i$ to $E_i$ which facilitates suction.

The velocity of the liquid of the circuits $C_1$ and $C_{1'}$ originates in each of these a flow which with each full rotation of the crankshaft 4 varies continuously from a value null to a peak value from which it decreases until it again takes on value null for an instant. The flows of the two circuits out of phase for an angle θ=180° have identical behavior and their sum is the flow of the 2-phase pump. The relative phase displacement of 180° of the two component flows tends to equalize the instantaneous flow of the pump whose value with respect to the mean value is subject to a peak deviation on the order of 20%.

In the above discussion allowance is not made for atmospheric pressure and kinetic energy of the liquid contained in the connecting circuits. They require that the null value of the above velocity be greater than zero.

C.2) The 4-Phase Pump

This type of pump has the purpose of obtaining steadiness of the flow and consequently also higher yield of the system and better efficiency of the system of suction of the liquid from the source.

The pump is termed 4-phase because at its inlet there are four active circuits subjected to inertial forces with relative phase θ=0°,90°,180°,270°.

It consists of (see FIGS. 8, 12, 14 and associated descriptions) the parallel of two 2-phase pumps of which one is made from the series of two 2-phase identical circuits $CB_1$ arranged at the inlet and $CB_2$ arranged at the outlet and the other made up of the series of the two circuits identical to the foregoing $CB_{22}$ arranged at the inlet and $CB_{11}$ at the outlet. The pair of circuits $CB_1$ and $CB_{11}$ is connected with the above mentioned procedures to the rotor $R_1$ with relative phase θ=0° while to the rotor $R_2$ with relative phase θ=90° is connected the pair $CB_2$ and $CB_{22}$ (see FIG. 14). In special cases the four rotors $R_1$, $R_2$, $R_{11}$, $R_{22}$ with relative phase θ=0°,90°,180°,270° to which are respectively fastened the circuits $CB_1$, $CB_2$, $CB_{11}$, $CB_{22}$ (see FIG. 12) are employed.

At normal operating speed the pressure generated by each 2-phase pump has an identical instantaneous value because each consists of a series of two identical 2-phase circuits subject to identical accelerations. Therefore the two 2-phase pumps in parallel are mutually independent.

Again at normal operating speed in the range θ(0°; 360°) the mean value of the flow of each 2-phase pump is identical.

But because of the different phase at the inlet and outlet their instantaneous value varies periodically so that the peak flow of a pump is simultaneous with the minimum value of the other. This causes equalization of the instantaneous flow of the 4-phase pump which is equal to the sum of the two flows so that the peak deviation of the flow from its mean value is on the order of 0.5%. Therefore the in and out flow of the pump is practically constant and in addition it has a mean value double that of each component pump.

This brings great regularity of operation, reduction of hydraulic losses in the circuits external to the pump and high efficiency of the suction system.

C.3) The Multifunction Pump

The multifunction pump has the purpose of simultaneously satisfying multiple pumping requirements in order to reduce construction and system costs as well as the dimensions thereof.

In the prior art a different pump must be used normally for each pumping requirement different as to flow, pressure or liquid pumped.

With the proposed pump (see FIG. 12, 14 and associated description) the problem can be solved simply by putting in common all the mechanical part of a pump consisting of support frame, motor, crankshaft, connecting rods, rotors and associated rotation shafts and also by fastening on the rotor with the applicable procedures the 2-phase circuits necessary for the required pumps connected as explained above and on the support frame 1 the associated inlets $E_{ol}$ and outlets $U_{ol}$. In this manner the various pumps are distinguished only by the different hydraulic circuit. This of course implies correct sizing of the mechanical parts.

There is no doubt that construction costs and dimensions of the multifunction pump are much less than total construction costs and dimensions of the separate pumps. Behavior is comparable to that of an electric transformer with a primary circuit and several secondaries which costs less and is smaller than the assemblage of transformers dimensioned for the same voltages and powers.

C.4) Connections of the 2-Phase Circuits and Rotor Rotation Shafts

The inlet and outlet of a 2-phase circuit (see FIGS. 12, 14) are both connected to the respective movable connector fastened to the rotor which is connected through a flexible tube to the corresponding fastened connector constrained to the support frame. The fastened connector can be part of the pump inlet or outlet or can be an auxiliary connector prepared for the series with another 2-phase circuit having different relative velocity.

The inlet and outlet of a 2-phase circuit are connected by means of the connector of FIG. 16 or 17. The connector consists of a main tube and two secondary tubes. The main tube is made up of a straight part which after a path parallel to the rotor rotation axis is bent so that its axis has a point in common with said rotation axis. After the bend it is connected with a flexible tube connected with a fastened connector constrained to the opposite side of the support frame. The flow of the two secondary tubes of the connector runs through the main tube. These tubes can have an axis in common as in the connector of FIG. 16 or can be parallel and spaced as in the connector of FIG. 17. The two secondary tubes are connected directly with the two inlets or the two outlets of the two active circuits of a 2-phase circuit. The connector of FIG. 16 is used e.g. for the inlets and outlets of the circuit FIG. 3. The connector of FIG. 17 is to be used e.g. for the outlet of the 2-phase circuit of FIG. 4 in which the outlets of the active circuits are spaced.

Summarizing what is discussed above in various paragraphs the connection of two connectors is done respecting the following rules. 1) The axes of the movable inlet and outlet connectors of the 2-phase circuit constrained to the rotor initiate in two opposite semiplanes with respect to the rotor rotation axis and are perpendicular to that axis, 2) the corresponding fixed connectors are constrained on two opposite sides of the support frame and have their axes coplanar and perpendicular to the rotor rotation axis, 3) a plane perpendicular to the rotor rotation axis contains the axis of the movable inlet connector, the corresponding axis of the fastened connector and the axis of the corresponding connecting flexible tube. A different plane perpendicular to the rotor rotation axis contains the axis of the movable outlet connector, the corresponding axis of the fastened connector and the axis of the corresponding flexible connecting tube, 4) for $\phi=0$ (see FIG. 1) the axes of the two movable inlet and outlet connectors are identified with the corresponding axes of the fixed connectors, 5) each pair consisting of a movable connector and the corresponding fastened connector is connected by means of a flexible tube, 6) the path of the flexible tube can be straight, bent with only one peak or bent with several peaks.

Because of the oscillatory motion of the rotor each flexible tube is subject to alternating periodic bending stress while torsional stress is absent.

The above connection provides minimal stress on the flexible tube, full utilization of available space and absence of interference between the different components.

FIGS. 12 and 14 show that the presence in the support frame of two rotor rotation shafts has the following advantages. 1) Avoidance of the use of connectors with 180° bends for connection of two 2-phase circuits with less hydraulic losses and construction costs, and 2) arrangement of the pump inlet and outlet on opposite sides of the support frame instead of on only one side. The connecting rod-crankshaft system requires a single crankshaft for oscillation of multiple rotors arranged on two parallel shafts while the guided bearing system requires as many crankshafts as there are rotor oscillation shafts. Therefore the guided bearing system is especially cost effective only in the case of a single rotor oscillation shaft.

C.5) Oscillatory Motion of the Rotor Generated By a Guided Bearing

This system is an alternative to the connecting rod-crank system for generating a field of rotational accelerations suited to operation of the pumps described above.

The basic components are (see FIG. 19, a) a rotor 2 oscillating on a shaft 15 fastened to the support frame, b) a crankshaft 4 whose axis is parallel to the rotor rotation axis connected laterally to a motor which rotates on bearings fastened to the support frame and through the rotor avoiding interference with other components, c) two cranks 5 whose pin 7 is coupled to the bearing 9 and which rotate externally to the guides 45 and also have the function of balancing the eccentric counterweights of the bearing and crank pin, and d) two parallel guides 45 rigidly fastened to the rotor and arranged between the two cranks. The bearing is located between the guides. The internal surfaces of the guides are ground and belong to two parallel planes each spaced from the rotor rotation axis at a distance equal to the radius of the external ring of the bearing plus the necessary tolerance to allow the external ring to rotate on one guide independently of the other. This way with each rotation of the shaft 4 the external ring of the bearing rotates alternately on one of the two guides in the same rotation direction to transmit an oscillatory motion to the rotor.

To the parallel axes of the shafts 4, 7 and 15 belong in an orderly manner points $0_1$, 0, $0_2$ (see FIG. 19). The length $\overline{0_{10}}$ is the crank arm. The lengths $\overline{0_{10}}$ and $\overline{0_{10_2}}$ are dimensioned in relation to the breadth of the angle $\theta_o$ established for rotor oscillation.

The system described as compared with the connecting rod-crank system has the advantage of smaller size and reduced cost. It can effect oscillation of multiple rotors rotating on a single shaft and is suited to a broad range of applications for the above mentioned pumps.

With reference to the patent application concerning the hydraulic and mechanical devices explained in the foregoing description to which reference is made for the interpretation of the following, the undersigned applicant presents the claims concerning the following parts of the invention.

What is claimed is:

1. A 2-phase pump comprising two identical tubular 2-phase circuits in series made in the corresponding one-way valves and in a tube with axis curved in accordance with a circumference and fastened rigidly to two rotors subjected to periodic oscillatory motion with identical frequency and phase differing by 90° around a shaft fastened to a supporting frame.

2. A 4-phase pump comprising two identical tubular 2-phase pumps in parallel as set forth in claim 1 built in such a manner that at its inlet four active circuits with relative phases of 0°, 90°, 180°, 270° are arranged on two or four rotors with the two rotors being subjected to periodic oscillatory motion around a single shaft.

3. A 4-phase pump as set forth in claim 2 operating using two rotor pairs subjected to periodic oscillatory motion around two distinct parallel shafts using the same mechanical system.

4. A 2-phase pump comprising two identical tubular 2-phase circuits made in corresponding one-way valves and a tube with axis curved in accordance with a cylindrical spiral and fastened rigidly to two rotors subjected to periodic oscillatory motion with identical frequency and phase differing by 90° around a shaft fastened to a supporting frame.

5. A 4-phase pump comprising two identical tubular 2-phase pumps in parallel as set forth in claim 4 built in such manner that at its inlet four active circuits with relative phase of 0°, 90°, 180° and 270° are arranged on two or four rotors with the rotors being subjected to periodic oscillatory motion around a single shaft.

6. A 4-phase pump as set forth in claim 5 operating by using two rotor pairs subjected to periodic oscillatory motion around two distinct parallel shafts using the same mechanical system.

7. A 2-phase pump comprising two identical tubular 2-phase circuits in series made in the corresponding one-way valves and a tube with axis curved in accordance with a cylindrical spiral with turns superimposed and fastened rigidly to two rotors subjected to periodic oscillatory motion with identical frequency and phase differing by 90° around a shaft fastened to a supporting frame.

8. A 4-phase pump comprising two identical tubular 2-phase pumps in parallel as set forth in claim 7, built in such a manner that at its inlet four active circuits with relative phase of 0°, 90°, 180° and 270° with the rotors being subjected to periodic oscillatory motion around a single shaft are arranged on two or four rotors.

9. A 4-phase pump as set forth in claim 8, operating using two rotor pairs subjected to periodic oscillatory motion around two distinct parallel shafts using the same mechanical system.

10. A 2-phase pump comprising two identical tubular 2-phase circuits in series made in the corresponding one-way valves and a tube with axis curved in accordance with a frustum of an Archimedean spiral and rigidly fastened to two rotors subjected to periodic oscillatory motion with identical frequency and phase differing by 90° around a shaft fastened to a supporting frame.

11. A 4-phase pump comprising two identical tubular 2-phase pumps in parallel as set forth in claim 10 built in such a manner that at its inlet are arranged four active circuits with relative phase of 0°, 90°, 180° and 270° on two or four rotors with the rotors being subjected to periodic oscillatory motion around a single shaft.

12. A 4-phase pump comprising two 2-phase pumps in parallel as set forth in claim 11 operating using two rotor pairs subjected to periodic oscillatory motion around two distinct parallel shafts using the same mechanical system.

13. A 4-phase pump as defined in claim 11 being a multifunction pump having pumps with said circuits fastened only on four of said rotors.

14. A 2-phase pump comprising two identical tubular 2-phase circuits made in the corresponding one-way valves and several frustums flanked by a tube with axis curved in accordance with an Archimedean spiral and rigidly fastened to two rotors subjected to periodic oscillatory motion with identical frequency and phase differing by 90° around a shaft fastened to a supporting frame.

15. A 4-phase pump comprising two identical tubular 2-phase pumps as set forth in claim 14 built in such a manner that at its inlet are arranged four active circuits with relative phase of 0°, 90°, 180° and 270° on two or four rotors with the rotors being subjected to periodic oscillatory motion around a single shaft.

16. A 4-phase pump as set forth in claim 15 using two rotor pairs subjected to periodic oscillatory motion around two distinct parallel shafts using the same mechanical system.

17. A pump in accordance with one of the above claims characterized in that the connection by means of a flexible tube of the moving inlet and outlet unions of each 2-phase circuit constrained to a rotor with the corresponding fixed unions constrained to a supporting frame is built in such a manner that: a) the axes of the moving inlet and outlet unions begin at two points arranged at opposite sides of the rotor rotation axis; b) said axes together with the axes of the corresponding fixed unions and flexible connecting tubes belong to two distinct planes perpendicular to said rotation axis; c) the two fixed unions are fastened on two opposite sides of the supporting frame and arranged in such a manner that at maximum rotor speed their axes coincide with the axes of the moving unions.

* * * * *